US006722956B2

(12) United States Patent
Okuyama et al.

(10) Patent No.: US 6,722,956 B2
(45) Date of Patent: Apr. 20, 2004

(54) WORKING APPARATUS

(75) Inventors: Tetsuo Okuyama, Kanagawa (JP); Shirou Murai, Kanagawa (JP); Kunihiro Saita, Kanagawa (JP); Toyotaka Wada, Kanagawa (JP); Tomoyuki Kawatsu, Kanagawa (JP)

(73) Assignee: Nippei Toyama Corporation, Tokyo (JP)

( * ) Notice: Subject to any disclaimer, the term of this patent is extended or adjusted under 35 U.S.C. 154(b) by 24 days.

(21) Appl. No.: 09/748,385

(22) Filed: Dec. 27, 2000

(65) Prior Publication Data

US 2001/0006880 A1 Jul. 5, 2001

(30) Foreign Application Priority Data

| | | |
|---|---|---|
| Dec. 27, 1999 | (JP) | P. 11-369037 |
| Dec. 27, 1999 | (JP) | P. 11-370149 |
| Dec. 28, 1999 | (JP) | P.11-372108 |
| Nov. 14, 2000 | (JP) | P.2000-346187 |
| Nov. 14, 2000 | (JP) | P.2000-346188 |

(51) Int. Cl.[7] ..... B24B 1/00

(52) U.S. Cl. ..... 451/57; 451/5; 451/8; 451/10; 451/11; 451/28; 451/36; 451/58; 451/65

(58) Field of Search ..... 451/5, 8, 10, 11, 451/28, 36, 57, 58, 65

(56) References Cited

U.S. PATENT DOCUMENTS 3,848,285 A * 11/1974 Braun et al. ..... 12/17 R

FOREIGN PATENT DOCUMENTS

| | | |
|---|---|---|
| JP | 50-63580 A | 10/1973 |
| JP | 63-7504 U | 3/1988 |
| JP | 64-40269 A | 2/1989 |
| JP | 1-257555 | 10/1989 |
| JP | 2-90032 U | 7/1990 |
| JP | 5-146937 A | 6/1993 |

* cited by examiner

*Primary Examiner*—Joseph J. Hail, III
*Assistant Examiner*—Shantese McDonald
(74) *Attorney, Agent, or Firm*—Sughrue Mion, PLLC

(57) ABSTRACT

A finishing grindstone member (20) is fixed to a spindle (10) by a bolt. In the spindle (10), there is formed a tool mounting portion (25) into which a rough grindstone member can be mounted. Into the tool mounting portion (25), there can be mounted not only the rough grindstone member but also a cover member (36). After a silicone wafer is roughly ground using the rough grindstone member, when finish grinding the silicone wafer using the finishing grindstone member (20), the cover member (36) is mounted onto the tool mounting portion (25) to thereby prevent the tool mounting portion (25) from being soiled.

21 Claims, 27 Drawing Sheets

WORKING APPARATUS

BACKGROUND OF THE INVENTION

1. Field of the Invention

The present invention relates to a working apparatus such as a one-surface grinding apparatus which is used to work the back surface of a wafer with an IC (Integrated Circuit), an edge grinding apparatus for working the edge of a circular-shaped thin plate and a machining center for performing many kinds of workings with many kinds of working tools.

2. Description of the Related Art

For example, in producing an IC tip, after an IC (Integrated Circuit) is produced on one surface of a mirror-surface silicone wafer, as a wafer's back surface working operation, a grinding operation is executed on the other surface of the silicone wafer. In this case, firstly, one surface, namely, the back surface of the silicone wafer is roughly cut using a rough grindstone. After completion of the rough cutting operation, the thus rough cut surface is ground using a finishing grindstone to thereby carry out a finishing treatment on the same.

Also, in grinding a circular-shaped thin plate such as a semiconductor wafer, surface grinding is firstly executed. After completion of the surface grinding, the outer peripheral edge of the semiconductor wafer is ground. Conventionally, as such wafer edge grinding, only the rough grinding is executed; but, recently, for the wafer edge grinding as well, there has been requested finishing grounding. Therefore, in the wafer edge grinding operation as well, the wafer edge is firstly ground roughly and, after then, finish grounding is executed on the roughly ground edge of the wafer.

When one surface of the wafer is ground, conventionally, there is used a one surface grinding apparatus which uses, for example, two spindles. In this one surface grinding apparatus, a rough grindstone is mounted on one of the two spindles, while a finishing grindstone is mounted on the other. And, the wafer is roughly ground using the rough grindstone mounted on one spindle and, after then, the wafer is moved to the position of the other spindle and is then finish ground using the finishing grindstone.

And, there is also used a one surface grinding apparatus which uses a spindle. In the case of this one surface grinding apparatus, a grindstone is mounted onto the spindle by a bolt and is then used to grind one surface of a work. More specifically, in this grinding apparatus, when the roughness of the grindstone must be changed as a grinding process progresses, for example, an operator unbolts the bolt to thereby remove the grindstone by hand and, next, the operator mounts a new grindstone onto the spindle.

However, of the above-mentioned two conventional one surface grinding apparatus, in the case of the one surface grinding apparatus using two spindles, because two spindles are necessary, the whole one surface grinding apparatus is complicated in structure and large in size. Also, there is further necessary a delivery device which is used to deliver a work between the two spindles.

On the other hand, in the case of the one surface grinding apparatus using a spindle, it is necessary to replace the grindstone each time the grinding process progresses. This raises a problem that the operator has to take much time and labor. Also, because the grindstone must be manually replaced by the operator, it takes long time to complete the whole grinding operation.

In order to solve the above problems, for example, there is known a one surface grinding machine which is disclosed in JP-A-1-257555. This one surface grinding machine comprises a plurality of cup-type grindstones disposed concentrically with one another and differing in diameter and kind from one another, and drive means for driving these cup-type grindstones individually. And, the plurality of cup-type grindstones are capable of executing grinding operations ranging from a rough grinding operation up to a finish grinding operation on a work in accordance with the feeding movements of the work. In the case of this one surface grinding machine, the whole apparatus (that is, the whole of the one surface grinding machine) can be made compact.

However, in the one surface grinding machine disclosed in the above-cited publication, in case where the grindstone is worn and degraded, an operator replaces the degraded grindstone with a new grindstone by hand. Therefore, not only it takes time and labor to grind the work, but also it takes time to execute the grindstone replacing operation. This drawback is also caused in the conventional edge grinding machine as well.

SUMMARY OF THE INVENTION

The present invention aims at eliminating the above drawbacks found in the conventional working apparatus. Accordingly, it is an object of the invention to provide a working apparatus which is simple in structure and small in size, does not cost an operator enormous labor, and is capable of executing a grinding operation in a short time.

In attaining the above object, there is provided a working apparatus for working a work, including: a spindle fixedly mounted with a first working tool for working the work in a specific manner. The spindle is formed with a tool mounting portion mountable onto a second working tool.

Accordingly, in a spindle onto which a grinding tool can be mounted, there is formed a tool mounting portion such as a grindstone mounting portion; and, a grinding tool such as a grindstone to be mounted into the tool mounting portion can be replaced using an automatic tool replacement device. Thanks to this, a single spindle can be used and, when compared with a structure using two spindles, the whole one surface grinding apparatus can be reduced in size.

Also, an operation to replace a worn grinding tool can be facilitated, an operator can be set free from enormous time and labor necessary for the grinding tool replacing operation, and the grinding operation can be executed in a short time. Further, since the grinding operation can be carried out while replacing a grindstone with a second grindstone having different roughness, the grinding operation can be carried out with high efficiency as a whole.

DETAILED DESCRIPTION OF THE PREFERRED EMBODIMENTS

Now, description will be given below in detail of a mode for carrying out the invention with reference to the accompanying drawings.

Figure 1:
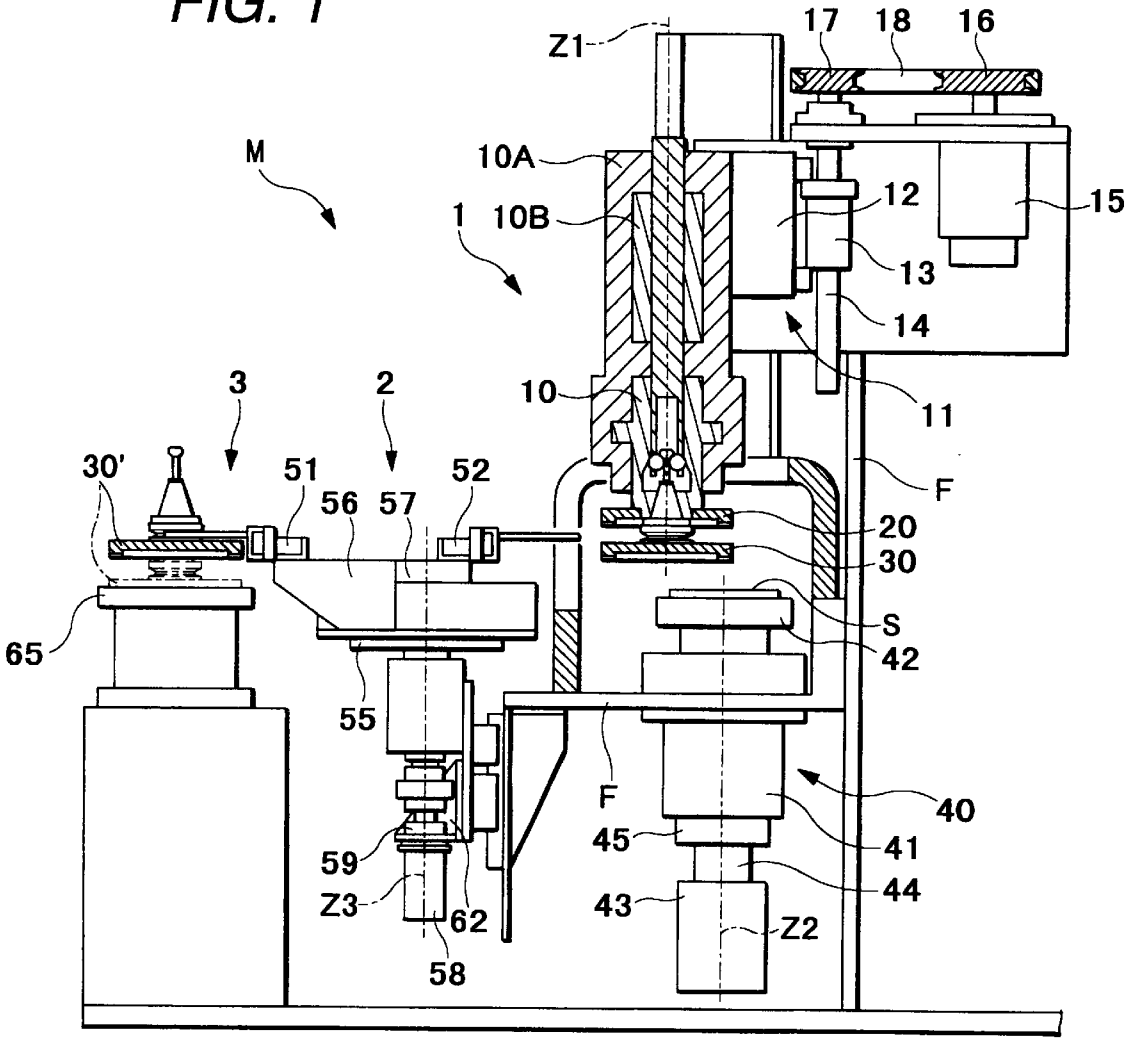
FIG. 1 is a front view of a one-surface grinding apparatus used as a working apparatus according to the invention.
Figure 2:
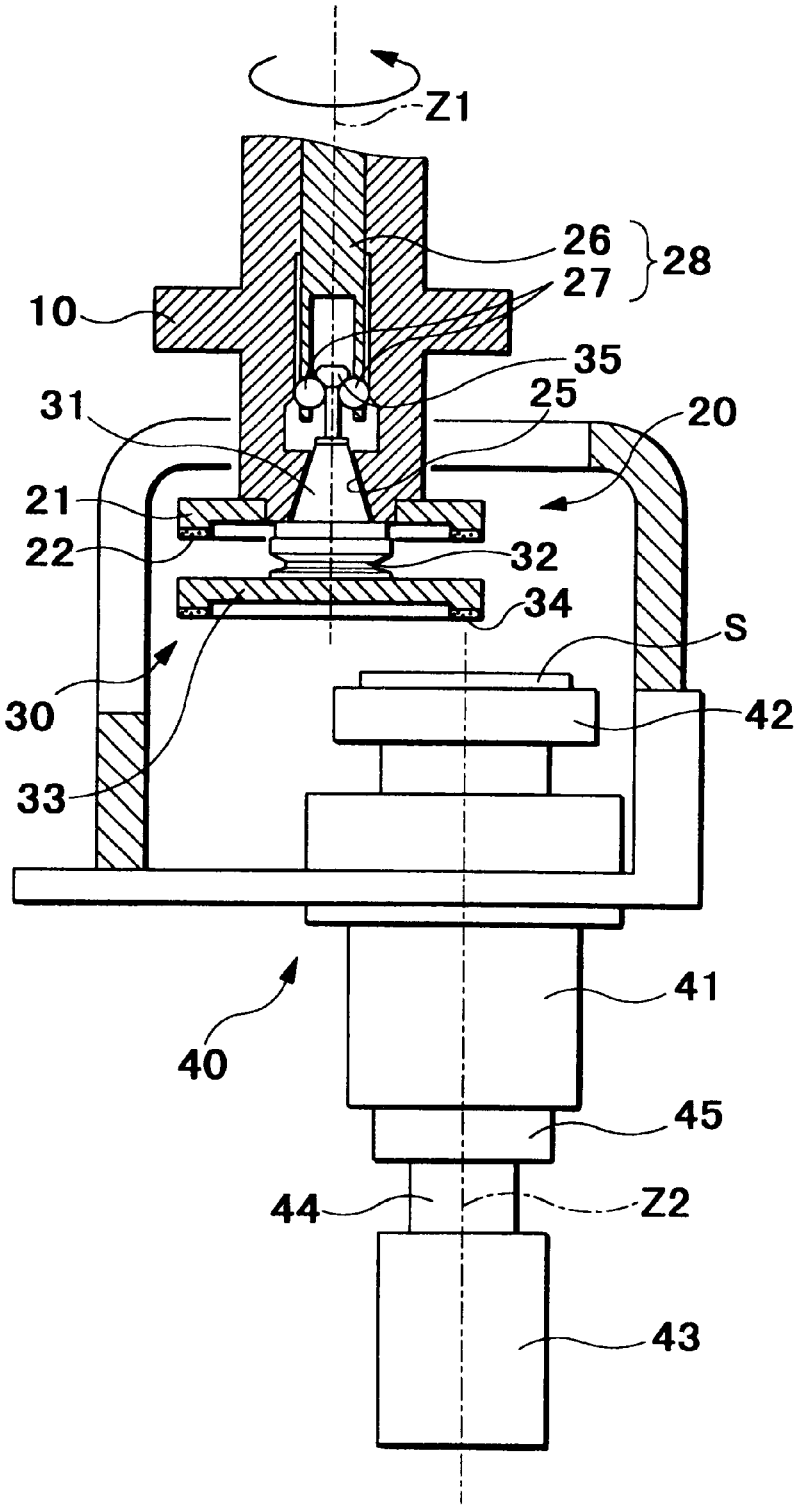
FIG. 2 is a front view of a grinding portion formed in the above one-surface grinding apparatus.
Figure 3:
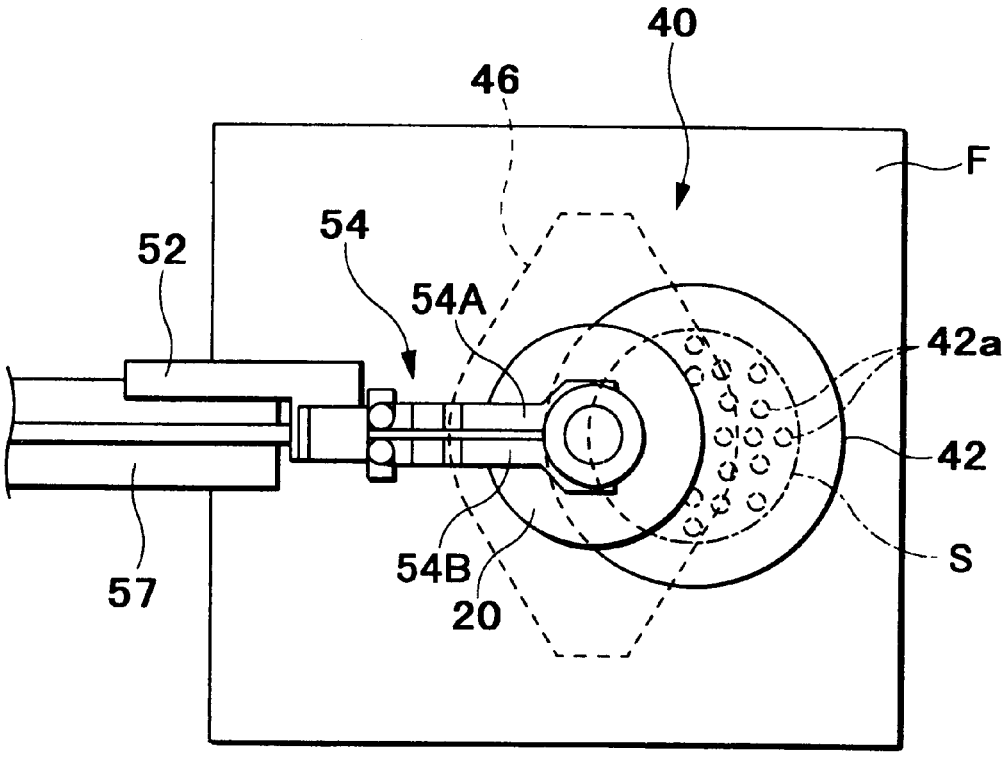
FIG. 3 is a plan view of the above grinding portion.

Specifically, FIG. 1 is a front view of a one-surface grinding apparatus used as a working apparatus according to the invention, FIG. 2 is a front view of the grinding portion of the one-surface grinding apparatus, and FIG. 3 is a plan view thereof.

As shown in FIG. 1, the one-surface grinding apparatus M includes a grinding portion 1, an automatic tool replacement device 2, and a grindstone stocker 3.

In the grinding portion 1, as shown in FIG. 2 as well, there is disposed a spindle 10 which is capable of rotating around a vertical axis Z1. A housing 10A for supporting the spindle 10 in a rotatable manner, as shown in FIG. 1, is mounted on a moving base 12 of a spindle vertically moving apparatus 11 and also incorporates therein a spindle motor 10B for rotationally driving the spindle 10. On the moving base 12, there is mounted a ball nut 13. This ball nut 13 is screwed into a ball screw 14 rotatably (around its own axis) supported on a box-shaped frame F; and, by rotating the ball screw 14, the spindle 10 can be moved up and down through the ball nut 13, moving base 12 and housing 10A. Also, in the box-shaped frame F, there is disposed a motor 15. A drive pulley 16 is disposed on the drive shaft of the motor 15, while a driven pulley 17 is disposed on the upper end portion of the ball screw 14. Further, the drive pulley 16 and driven pulley 17 are connected to each other through a belt 18. And, by driving the motor 15, the ball screw 14 can be rotated through the belt 18.

Figure 4A:
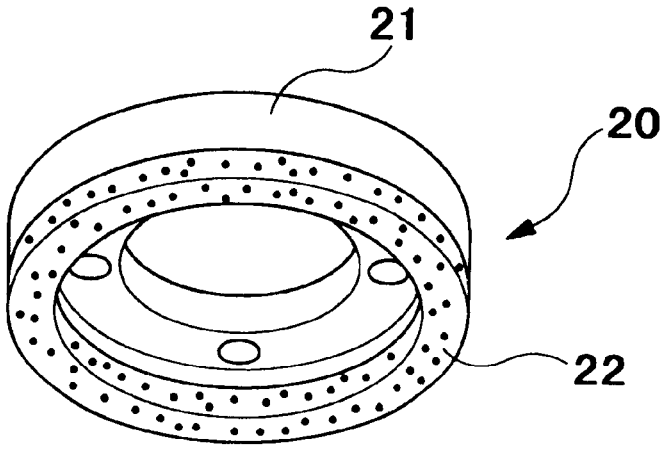
FIG. 4A is a perspective view of a finishing grindstone member.
Figure 5:
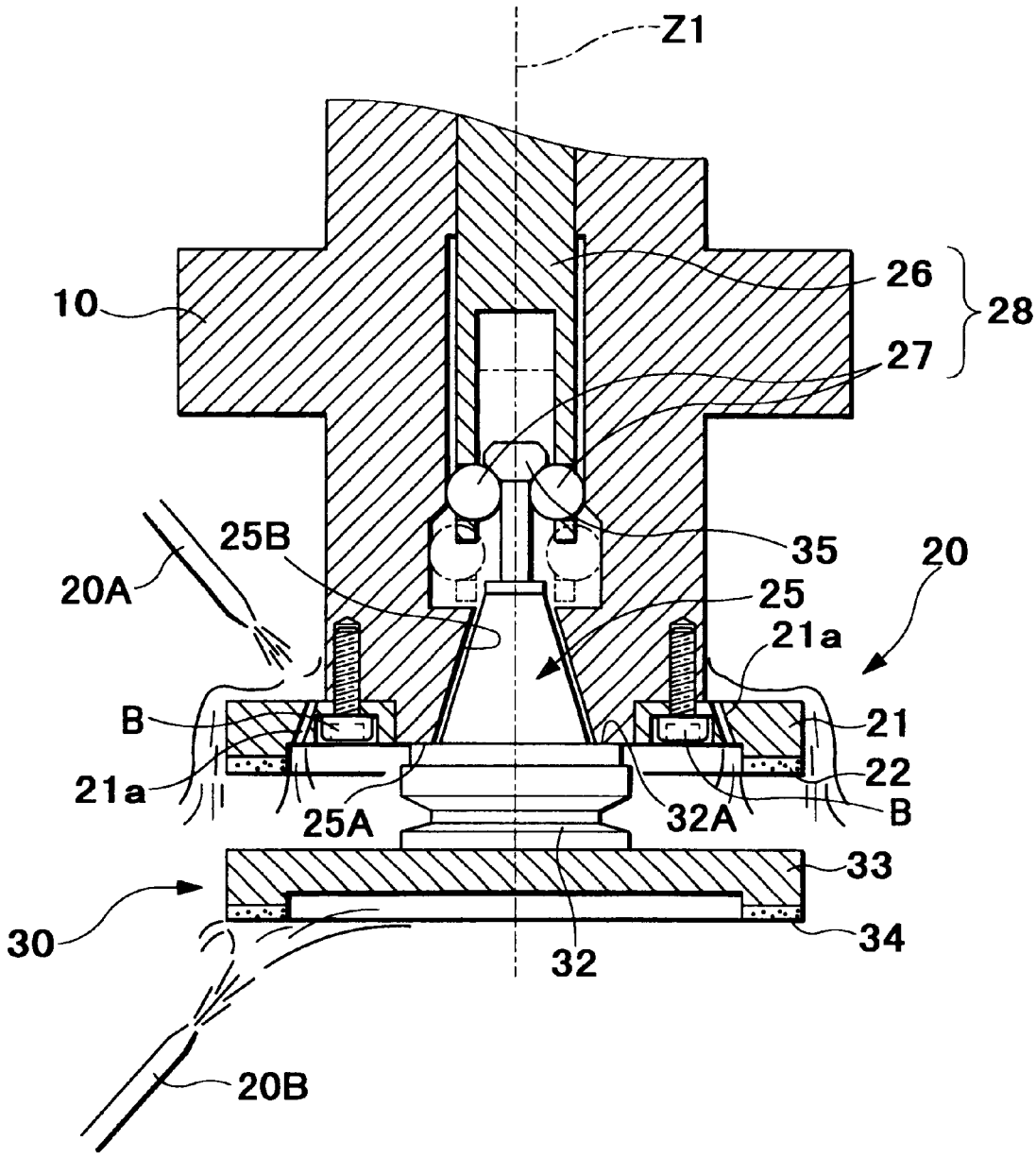
FIG. 5 is an enlarged sectional front view of a spindle with a rough grindstone holder mounted thereon.

Also, to the lower end (leading end) portion of the spindle 10, as shown in FIGS. 1 and 2, there is fixed a finishing grindstone member 20. The finishing grindstone member 20, as shown in FIG. 4A, includes a ring-shaped grindstone base 21; and, in case where the ring-shaped grindstone base 21, as shown in FIG. 5, is secured to the spindle 10 by bolts B, B each having a hexagonal hole, the finishing grindstone member 20 is fixed to the spindle 10. To the ring-shaped grindstone base 21, there is fixed a finishing grindstone 22 which is a hollow-cylindrical-shaped finishing grindstone 22 of a cup type. As the finishing grindstone 22, there is used a fine grindstone having a mesh size #2000 or so. Also, in the grindstone base 21, there are formed a plurality of working liquid supply holes 21*a*, 21*a* which are respectively so opened as to be situated inside the finish grindstone 22; and, working liquid such as water can be jetted out through the working liquid supply holes 21*a*, 21*a* from the upper surface side of the grindstone base 21 to the finish grindstone 22. Further, in the spindle 10, there is formed a tool mounting portion 25 which is coaxial with the finish grindstone 22 and consists of a mounting hole having a tapered shape. Upwardly of the tool mounting portion 25, there is disposed a well-known clamp mechanism 28 which is composed of a draw bar 26 and balls 27, 27.

Figure 4B:
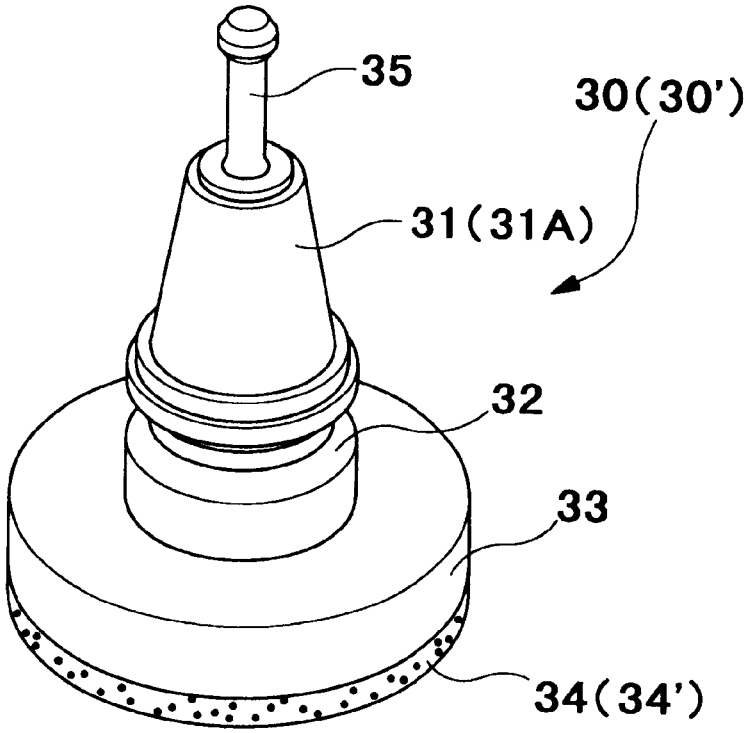
FIG. 4B is a perspective view of a rough grindstone holder.

Also, in a rough grinding operation to be executed before a finish grinding operation which is carried out by the finishing grindstone member 20, as shown in FIGS. 2 and 5, onto the tool mounting portion 25, there is mounted a rough grindstone holder 30 which can be mounted into and removed from the tool mounting portion 25. This rough grindstone holder 30, as shown in FIG. 4B, includes a tapered shank portion 31 which can be inserted into the tool mounting portion 25, and a grip portion 32 which is formed forwardly of (in FIG. 2, downwardly of) the shank portion 31. The grip portion 32 can be held by two hold arms 51, 52 disposed in an automatic tool replacement device 2 which will be discussed later. On the portion of the rough grindstone holder 30 that is situated further forwardly than the grip portion 32, there is mounted a ring-shaped grindstone base 33; and, to the grindstone base 33, there is fixed a hollow cylindrical-shaped rough grindstone 34. As the rough grindstone 34, for example, there can be used a rough grindstone having a mesh size of #600 or so. Further, in the rear of the shank portion 31, there is disposed a pull stud 35. And, as shown in FIG. 2, when the rough grindstone holder 30 is fitted and mounted into the tool mounting portion 25, the pull stud 35 is pulled by the draw bar 26 with the balls 27, 27 interposed between them, so that the rough grindstone holder 30 can be clamped to the tool mounting portion 25 and can be thereby mounted at a given position thereof. At that time, as shown in FIG. 5, the back surface 32A of the grip portion 32 is in contact with the surface 25A of the tool mounting portion 25. For this reason, the taper surface 31A of the shank portion 31 of the rough grindstone holder 30 and the taper surface 25B of the tool mounting portion 25, formally, are not contacted with each other, but the tool mounting portion 25 and rough grindstone holder 30 are contacted with each other through their respective plane surfaces. Of course, in case where the tool mounting portion 25 and rough grindstone holder 30 are contacted with each other through their respective plane surfaces, it does not matter whether the taper surface 31A of the shank portion 31 and the taper surface 25B of the tool mounting portion 25 may be contacted with each other partially or wholly.

Further, as shown in FIG. 5, downwardly of the rough grindstone holder 30, there is disposed a nozzle 20B which is mounted on a box-shaped frame F (FIG. 1). When a rough grinding operation is executed by the rough grindstone 34, the working liquid such as water is jetted up to the rough grindstone 34 from the nozzle 20B which is disposed downwardly of the rough grindstone 34.

Also, a second rough grindstone holder 30', which is another rough working tool, has substantially the same structure as the rough grindstone holder 30. That is, the second rough grindstone holder 30' has such an outer shape as shown in FIG. 4B and includes a shank portion 31, a grip portion 32, a grindstone base 33 and a pull stud 35. However, a rough grindstone 34' to be mounted on the grindstone base 33 is finer in roughness than the rough grindstone 34 to be fixed to the rough grindstone holder 30. Here, in case where the mesh size of the rough grindstone 34 to be fixed to the rough grindstone holder 30 is, for example, #600, there is used, as the rough grindstone 34' to be fixed to the rough grindstone holder 30', a rough grindstone having a mesh size of, for example, #1200.

Figure 6:
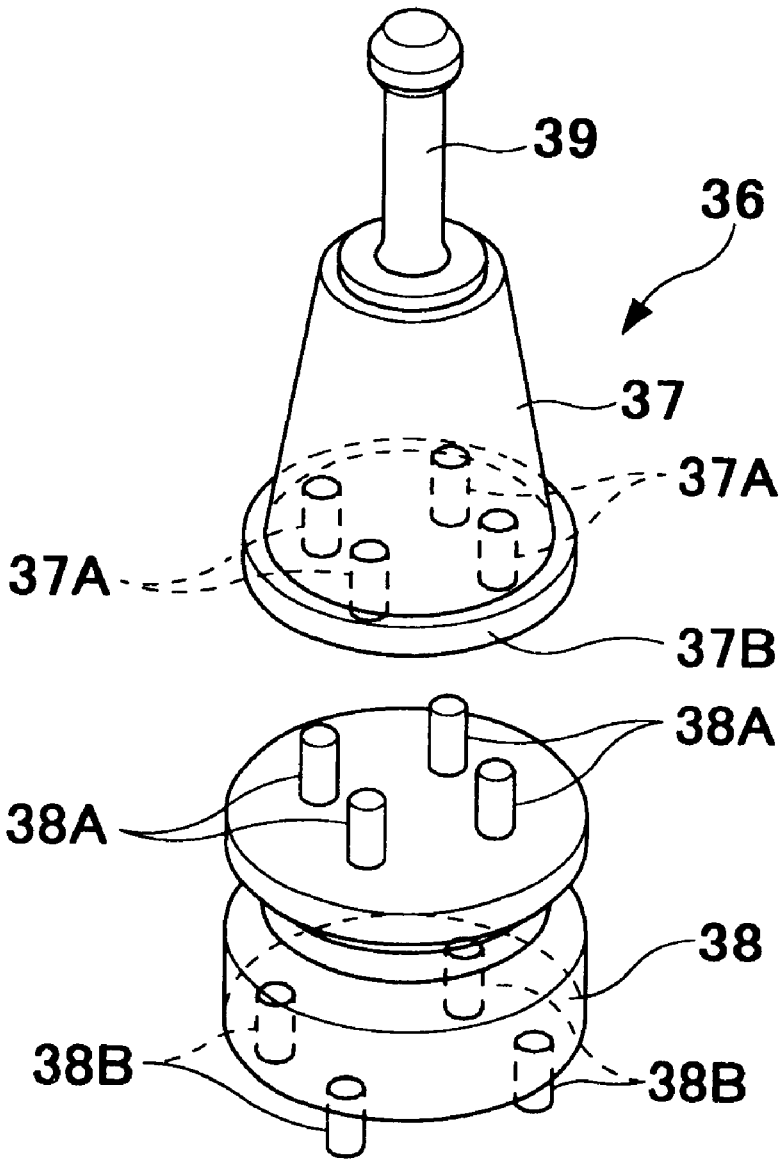
FIG. 6 is an exploded perspective view of a cover member for use in the invention.
Figure 7:
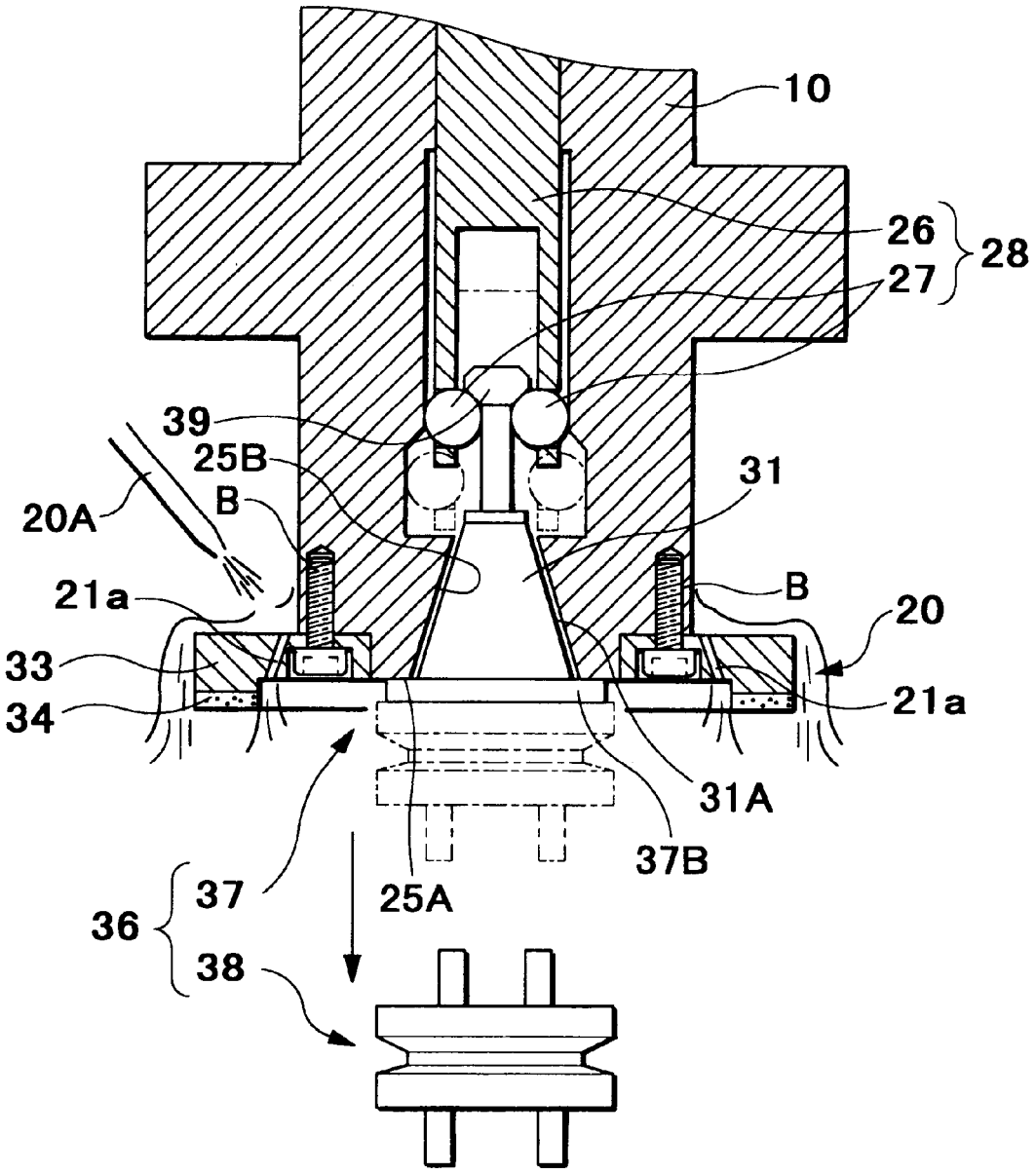
FIG. 7 is an enlarged sectional front view of a spindle with the above cover member mounted thereon.

Further, when a finish grinding operation is carried out using the finishing grindstone 22, as shown in FIG. 7, a cover member 36, which can be mounted onto and removed from the tool mounting portion 25 is mounted onto the tool mounting portion 25. This cover member 36, as shown in FIGS. 6 and 7, includes a main body portion 37 and a cover holder portion 38. The main body portion 37 and cover holder portion 38 are structured such that they can be separated from each other. The main body portion 37 is provided with a taper which has substantially the same inclination as the taper surface 31A of the shank portion 31 of the rough grindstone holder shown in FIG. 4B, while the main body portion 37 can be inserted into the tool mounting portion 25. Also, backwardly (in FIG. 7, upwardly) of the main body portion 37, there is mounted a pull stud 39 which has the same shape as the pull stud 35 disposed on the rough grindstone holder 30. As shown in FIG. 7, in case where the cover member 36 is fitted and mounted into the tool mounting portion 25, the pull stud 39 is pulled by the draw bar 26 with the balls 27, 27 interposed between them, so that the cover member 36 is clamped to the tool mounting portion 25 and thus mounted at a given position thereof.

Also, in the cover holder portion 38, there is formed a grip portion which has substantially the same shape as the grip portion 32 of the rough grindstone holder 30; and, the cover holder portion 38 can be held by arms 51, 52 disposed in an automatic tool replacement device which will be discussed later. Also, in the upper portion of the cover holder portion 38, there are provided four upper projections 38A, 38A, - - - ; and, in the lower portion of the cover holder portion 38 as well, there are formed four lower projections 38B, 38B, - - - . In the lower surface of the main body portion 37, more specifically, at the positions thereof that correspond to the upper projections 38A, 38A, - - - projecting from the portion of the cover holder portion 38, there are formed fit holes 37A, 37A, - - - which can be fitted with the upper projections 38A, 38A, - - - , respectively. That is, in case where the cover holder portion 38, 38, - - - of the cover holder portion 38 are fitted into these fit holes 37A, 37A, - - - , the main body portion 37 and cover holder portion 38, which are separated from each other, can be connected together into an integral body.

Further, on the front surface (lower surface) of the main body portion 37, there is formed a collar portion 37B. This collar portion 37B is formed in order that, as shown in FIG. 7, when the main body portion 37 is mounted into the tool mounting portion 25 of the spindle 10, the collar portion 37B can be surface contacted with the surface 25A of the tool mounting portion 25.

Also, downwardly of the spindle 10, as shown in FIGS. 1 and 2, there is disposed a vacuum hold and rotate device 40 capable of vacuum attracting and rotating a silicone wafer S one surface of which is to be ground; in other words, one surface of the silicone wafer S is used as a work according to the invention. This vacuum hold and rotate device 40 includes a housing 41 and, upwardly of the housing 41, there is mounted a rotary table 42 in such a manner that it can be rotated around a vertical shaft. In the rotary table 42, as shown in FIG. 3, there are formed a plurality of vacuum attract holes 42*a*, 42*a*, - - - . These vacuum attract holes 42*a*, 42*a*, - - - are respectively connected to an air pump (not shown) and are also structured such that, by applying a negative pressure to the air pump, they can attract and hold the silicone wafer S which is placed on the rotary table 42 and is shown by a virtual line in FIG. 3. Downwardly of the housing 41, there is disposed a motor 43; and, this motor 43 is connected to the rotary table 42 through a rotary shaft 44. By rotating the motor 43, the rotary table 42 can be rotated through the rotary shaft 44. Also, in the rotary shaft 44 which is interposed between the motor 43 and housing 41, there is disposed a reduction gear 45 which is used to transmit the rotation of the motor 43 while decelerating the same. Further, in the box-shaped frame F, as shown in FIG. 3, there is formed a discharge hole 46 which is used to discharge liquid wastes such as grinding fluid after they have been used in executing a grinding operation.

Also, the finishing grindstone 22 in the finishing grindstone member 20 has substantially the same diameter as the rough grindstone 34 in the rough grindstone holder 30, while this diameter is set equal to or larger than the diameter of a circular-shaped silicone wafer S one surface of which, that is, the work according to the invention, is to be ground or worked. And, when grinding one surface of the silicone wafer S using the grindstones 22, 34, as shown in FIG. 2, the positions of the grindstones 22, 34 are set such that the center positions of the thicknesses of the grindstones 22, 34 pass on a vertical axis Z2 which is the center of rotation of the silicone wafer S.

Laterally (in FIG. 1, on the left side of) of the grinding portion 1, there is disposed the automatic tool replacement device 2 which is used to replace the rough grindstone holder 30 mounted into the tool mounting portion 25 with the second rough grindstone holder 30' or other working tool and the cover member 36. Also, further laterally of the automatic tool replacement device 2, there is disposed the grindstone stocker 3 in which there are stored two or more kinds of working tools including the cover member 36 and rough grindstone holder 30.

Figure 8:
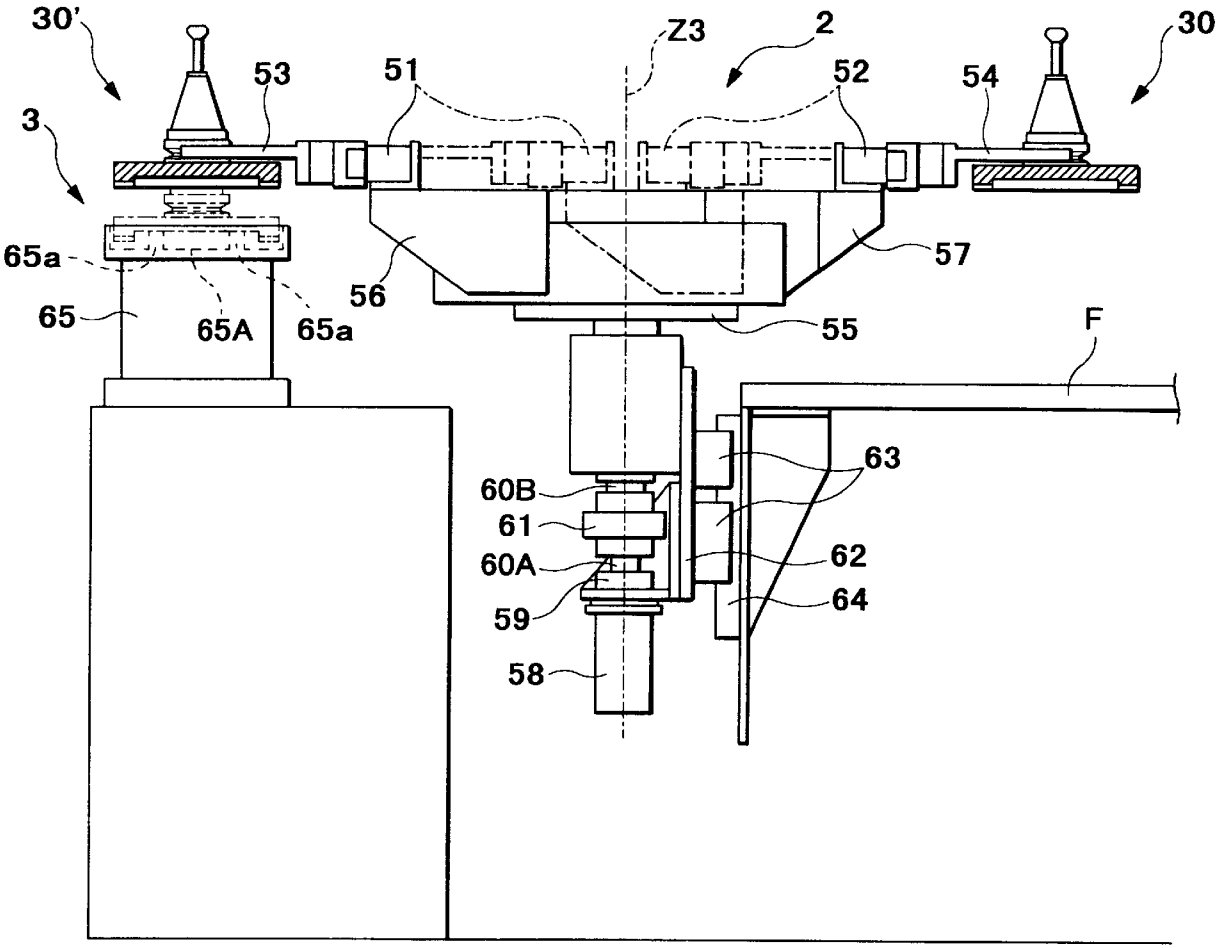
FIG. 8 is a front view of an automatic tool replacement device and a grindstone stocker.
Figure 9:
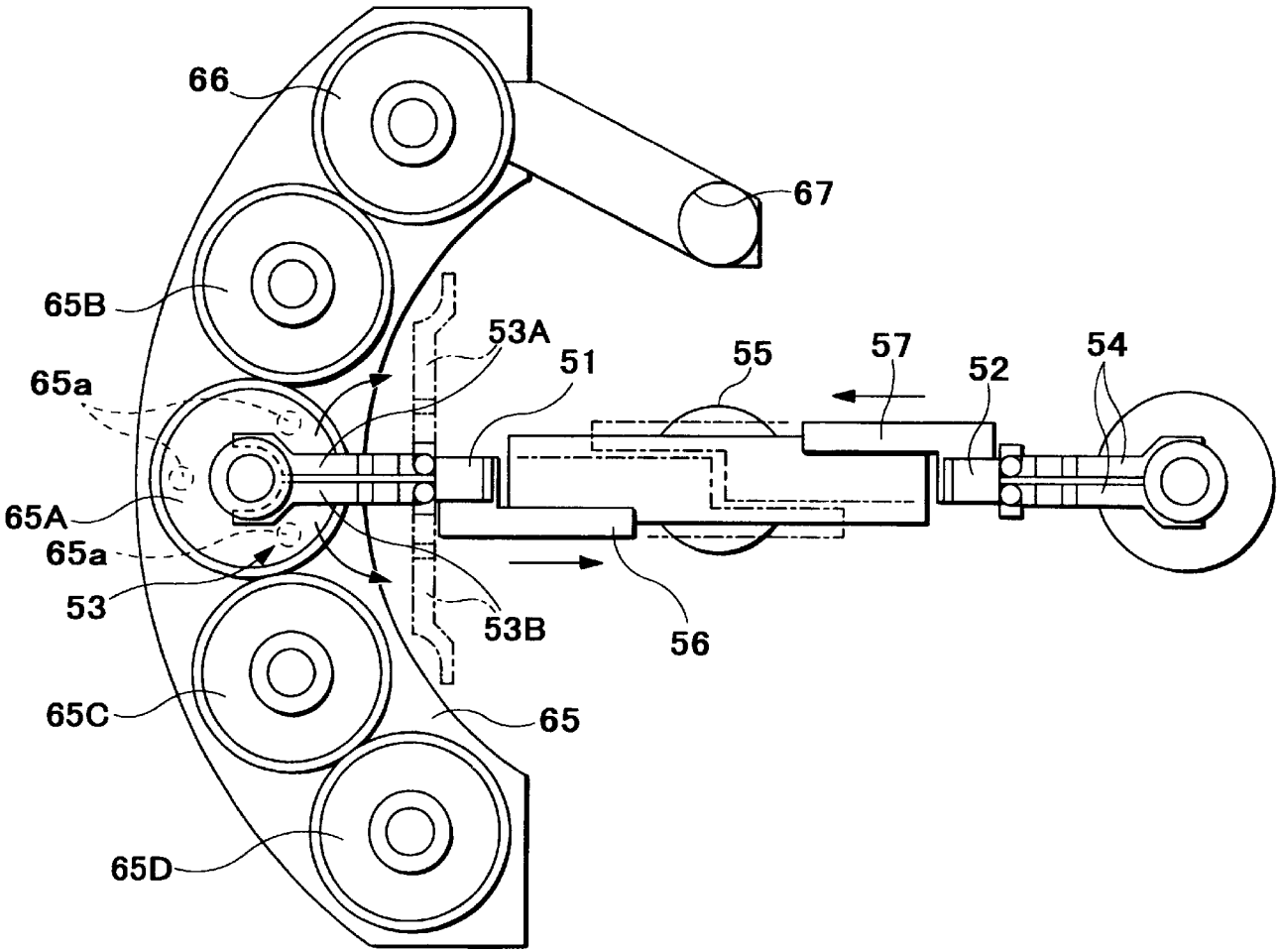
FIG. 9 is a front view of the above automatic tool replacement device and grindstone stocker.

The automatic tool replace device 2, as shown in FIGS. 8 and 9, includes first and second hold arms 51, 52 which can be respectively turned around a vertical shaft Z3. These two hold arms 51, 52 respectively extend outwardly in the radial direction thereof from their respective centers of turn; and, on their respective outer end portions of the hold arms 51, 52, there are disposed hold members 53, 54. One of them, that is, the hold member 53, as shown in FIG. 9, is composed of two hold pawls 53A, 53B which can be opened and closed symmetrically with respect to an axis extending along the longitudinal direction of the first hold arm 51. And, in case where the hold member 53 is closed, the grip portion 32 of the rough grindstone holder 30 shown in FIG. 4B and the cover holder portion 38 of the cover member 36 shown in FIG. 6 can be held by the hold pawls 53A, 53B. Also, the other hold member 54 has the same structure as one hold member 53: that is, the hold member 54 can be opened and closed symmetrically with respect to an axis extending along the longitudinal direction axis of the second hold arm 52; and, in the leading end portion of the hold member 54, similarly to the first hold member 53, there are disposed two hold pawls.

Also, downwardly of the first hold arm 51, there is disposed a turn table 55 which is used to turn the first hold arm 51. The hold arms 51, 52 are respectively placed on the moving bases 56, 57 of a rodless cylinder disposed on the turn table 55. In case where these rodless cylinder moving bases 56, 57 are slided, the hold arms 51, 52 can be respectively moved in the longitudinal direction thereof. Downwardly of the turn table 55, there is disposed a motor 58. This motor 58 is connected to the turn table 55 through a first rotary shaft 60A and a second rotary shaft 60B.

Also, the first rotary shaft 60A and second rotary shaft 60B are connected to each other by a coupling 61. And, by driving the motor 58, the turn table 55 can be turned around a vertical axis Z3 through the first and second rotary shafts 60A and 60B. In case where the turn table 55 is turned in this manner, the hold arms 51, 52 can be turned. Also, in the first rotary shaft 60A, there is disposed a reduction gear 59. This reduction gear 59 is used to reduce the rotation speed of the motor 58 down to a given speed.

Further, these turn table 55 and motor 58 are mounted on a vertically moving base 62. And, on the vertically moving base 62, there are mounted sliders 63, 63. These sliders 63, 63 can be slided in the vertical direction along a rail 64 which is fixedly secured to the box-shaped frame F. Also, the vertically moving base 62 is structured such that, in case where a vertically moving cylinder (not shown) is operated, it can be moved in the vertical direction. Thus, in case where the vertically moving cylinder (not shown) is operated to thereby move the vertically moving base 62 in the vertical direction, the hold arms 51, 52, the rough grindstone holder 30 held by the hold arms 51, 52, other working tools and the cover member 36 can be moved in the vertical direction.

The grindstone stocker 3 is disposed on the opposite side of the grinding portion 1 through the automatic tool replacement device 2. In the grindstone stocker 3, as shown in FIG. 9, there is disposed a storage base 65 which includes working tool storage portions 65A, 65B, - - - for storing therein a plurality of working tools including the plurality of rough grindstone holders 30, and a cover member storage portion 66 for storing therein the cover member 36. These working tool storage portions 65A, 65B, - - - and cover member storage portion 66 are arranged along a locus drawn by the hold member 53 when it is turned by the turn table 55 while the first hold arm 51 is moved fully to the radial-direction outside of the turn table 55. Also, in the respective working tool storage portions 65A, 65B, - - - , for example, there are stored rough grindstone holders respectively including rough grindstones differing in roughness from one another. However, it is also possible to store a plurality of rough grindstone holders respectively including rough grindstones having the same roughness in the respective working tool storage portions 65A, 65B, - - - .

On the working tool storage portion 65A, as shown in FIGS. 8 and 9, there are projectingly provided a plurality of (in the present embodiment, three) support blocks 65*a*, 65*a*, 65*a*. These support blocks, as shown in FIG. 8, are respectively disposed inside the rough grindstone 34 of the rough grindstone holder 30 which is stored within the working tool storage portion 65A. The bottom portion of the grindstone base 33 of the rough grindstone holder 30 is supported by the support blocks 65*a*, 65*a*, 65*a*, whereby the rough grindstone holder 30 is stored within the working tool storage portion 65A. Therefore, the rough grindstone 34 of the rough grindstone holder 30, when stored, is not in contact with the working tool storage portion 65A but is poised in the air, thereby preventing the rough grindstone 34 against wear or damage.

Also, although not shown, in the other working tool storage portions 65B, 65C, - - - as well, there are projectingly provided similar support blocks. And, when the grindstone holders are respectively stored within their associated working tool storage portions 65B, 65C, - - - , similarly, grindstones respectively held by these grindstone holders are stored within the working tool storage portions 65B, 65C, - - - in such a manner that they are not in contact with the working tool storage portions 65B, 65C, - - - but are poised in the air.

Figure 10A:
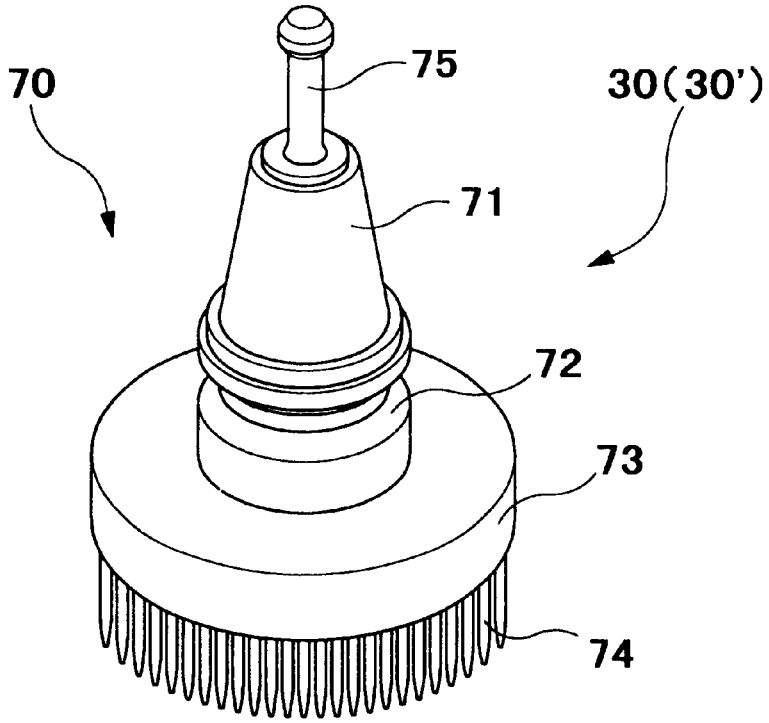
FIG. 10A is a perspective view of a brushing member.

Further, within the working tool storage portion 65C, there is stored a brushing member 70. This brushing member 70, as shown in FIG. 10A, includes a shank portion 71, a grip portion 72, and a brush base 73; and, on the brush base 73, there are disposed brushes 74 including grains. Also, on the shank portion 71, there is mounted a pull stud 75. Of these components of the brushing member 70, the shank portion 71, grip portion 72 and pull stud 75 are respectively identical in shape with the shank portion 31, grip portion 32 and pull stud 35 of the rough grindstone holder 30 shown in FIG. 4B. Also, the brush base 73 has substantially the same shape as the grindstone base 33 of the rough grindstone holder 30 but is different from the grindstone base 33 in that it includes a large number of hole portions (not shown) into which the nylon threads of the grain-containing brush 74 can be inserted. These hole portions are formed in a ring shape and, therefore, in the central portion of the brush base 73 when the brush base 73 is viewed from above, the nylon threads cannot be seen. By the way, in FIG. 10B, for the convenience of explanation, the thickness of the nylon thread N is drawn larger than the actual thickness thereof. And, while the brushing member 70 is stored within the working tool storage portion 65C, the central portion of the bottom portion of the brush base 73 is supported by support blocks (not shown), thereby preventing the leading end of the grain-containing brush 74 from rubbing against the working tool storage portion 65C.

Figure 10B:
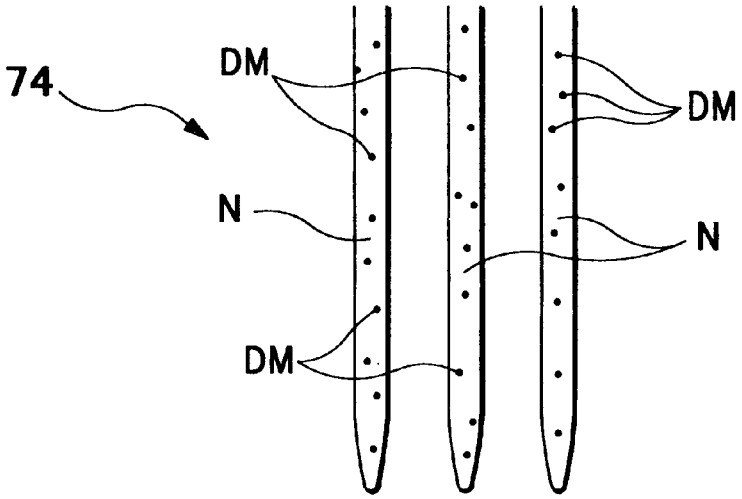
FIG. 10B is an enlarged view of a brush.

The grain-containing brush 74 mounted on the brush base 73, as shown enlargedly in FIG. 10B, is composed of a large number of nylon threads N, N, - - - studded with diamond grains DM, DM, - - - , so that the grain-containing brush 74 can provide the flexibility of the nylon threads N as well as the excellent grinding power of the diamond grains DM. Such grain-containing brush 74, for example, can be manufactured in the following manner. That is, firstly, the diamond grains DM, DM, - - - are mixed into a solvent composed of nylon material which is melt in a liquid state. In case where this solvent is pushed out in the form of a thread and is then hardened, there is produced a nylon thread N in which the diamond grains are fixed firmly. A plurality of thus produced nylon threads N, N are collected together and mounted on the brush base 73, so that the grain-containing brush 74 can be manufactured.

By the way, as the grain-containing brush 74, it is not always essential to use a brush including nylon threads but other suitable brushes can also be used. Also, as the grains that should be mixed and fixed into the brushes, preferably, diamond grains or $SiO_2$ grains may be used but this is not limitative. That is, according to cases, known grains can also be mixed and fixed into the brushes.

For example, as the grains according to the invention, there can be used not only the above-mentioned diamond grains and $SiO_2$ grains, but also $Al_2O_3$, $ZrO_2$, SiC, CBN, $B_4C$, $Fe_2O_3$, $Cr_2O_3$, $CeO_2$, $ZrB_2$, $TiB_2$, and TiC minute particles or grains. Referring to the size of the grains, the mean grain diameter may be equal to or less than 10 $\mu$m; preferably, it may be equal to or less than 5 $\mu$m; more preferably, it may be equal to or less than 1 $\mu$m; and, ideally, it may be equal to or less than 0.2 $\mu$m. However, according to objects to be ground or polished, the mean grain diameter may be selected properly. As the shape of the grains, preferably, a spherical shape or a shape close to a spherical shape may be selected. However, depending on an object to be ground, grains having other shapes can also be used.

By the way, in the working tool storage portions 65A, 65B, - - - , as the need arises, instead of the rough grindstone holder 30 and brushing member 70, there can also be stored an etching tool or a polishing tool including a polishing pad.

Also, in the cover member storage portion 66, there is stored the cover member 36. While the cover member 36 is stored within the cover member storage portion 66, the cover member 36 is so held as to stand up due to lower projection portions 38B, 38B, - - - which are respectively provided on the cover holder portion 38 of the cover member 36.

Further, on the radial-direction inner side of the locus drawn by the hold member 53 obtained when it is turned by the turn table 55 while the first hold arm 51 is moved fully to the radial-direction outside of the turn table 55, there is disposed a cover holder storage portion 67. In this cover holder storage portion 67, there can be stored the cover holder portion 38 of the cover member 36 that is made redundant while a finish grinding operation is being executed in the grinding portion 1 using the finishing grindstone 20. When storing the cover holder portion 38 into the cover holder storage portion 67, the lower projection portions 38B, 38B, - - - are respectively inserted into their associated positioning grooves (not shown) which are formed in the cover holder storage portion 67. And, the fit holes 37A, 37A, - - - formed in the main body portion 37 mounted on the tool mounting portion 25 and the upper projection portions 38A, 38A, - - - provided on the cover holder portion 38 are arranged such that their mutual position relation is prevented from being shifted.

Now, description will be given below of the operation of the one-surface grinding apparatus M having the above structure.

When executing a one surface grinding operation using the one-surface grinding apparatus M, the silicone wafer S, which is to be ground or worked as a work, is delivered and placed by a robot (not shown) onto the rotary table 42 of the vacuum hold and rotate apparatus 40 disposed in the grinding portion 1. The silicone wafer S, which has been placed on the rotary table 42, is vacuum attracted by negative pressures given from the vacuum attract holes 42*a*, 42*a*, - - - of the rotary table 42. One surface of this silicone wafer S is firstly roughly ground by a rough grindstone and is then roughly ground by another rough grindstone having proper but different roughness; and, after then, the thus roughly ground one surface of the silicone wafer S is finally finish ground using a finishing grindstone. When executing the finish grinding operation using the finish grindstone member 20, in order to prevent the tool mounting portion 25 from being soiled with the grinding liquid, the cover member 36 is mounted onto the tool mounting portion 25.

Figure 11:
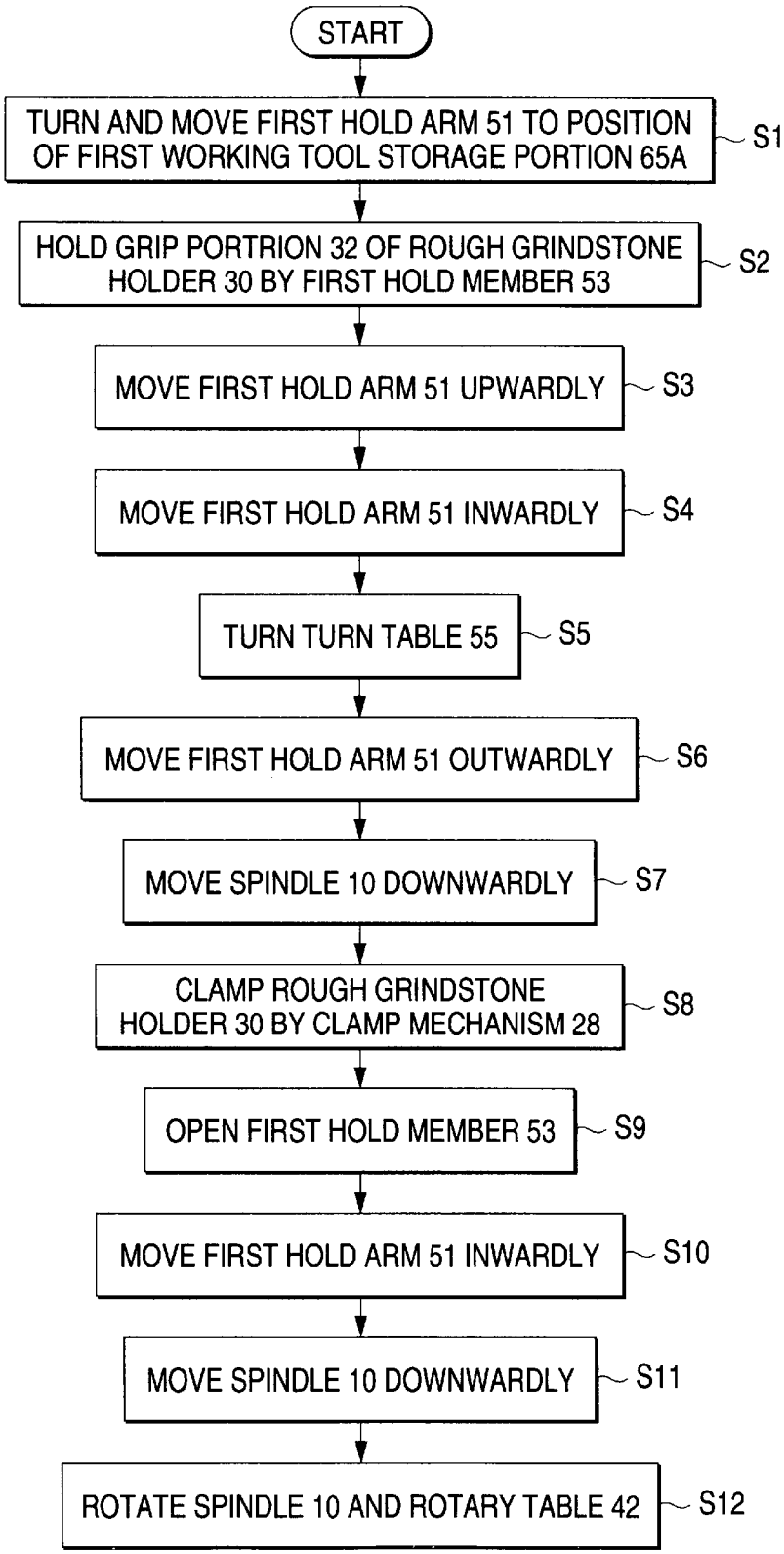
FIG. 11 is a flow chart of a process including the step of mounting a rough grindstone member into the tool mounting portion of a spindle up to the step of starting a rough grinding operation using the rough grindstone member.

In this operation process, the rough grindstone holder 30, which is used in the rough grinding operation that is executed initially, is mounted into the tool mounting portion 25 formed in the spindle 10. Now, assuming that the rough grindstone holder 30 is stored in the working tool storage portion 65A of the grindstone stocker 3, description will be given below of the procedure starting from an operation to mount the rough grindstone holder 30 into the tool mounting portion 25 up to an operation to execute a rough grinding operation with reference to a flow chart shown in FIG. 11 as well as step views respectively shown in FIGS. 12A to 13C.

Figure 12A:
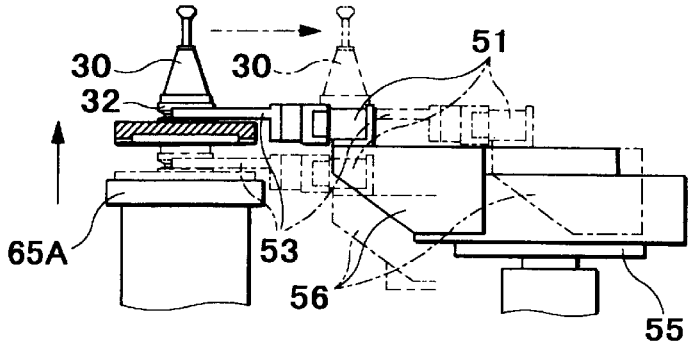
FIGS. 12A to 12C are side views of the one-surface grinding apparatus, showing the above process including the step of mounting a rough grindstone member into the tool mounting portion of a spindle up to the step of starting a rough grinding operation using the rough grindstone member.

The first hold arm 51 holding the rough grindstone holder 30 of the automatic tool replacement device 2, as shown by a virtual line in FIG. 12A, is set at the same position as the grip portion 32 of the rough grindstone holder 30 stored in the first working tool storage portion 65A. At the then time, the hold member 53 of the first hold arm 51 is opened. From this state, the first hold arm 51 is turned and moved to the position of the first working tool storage portion 65A of the grindstone stocker 3 in which the rough grindstone holder 30 used to execute a rough grinding operation is stored (S1). Here, when the first hold arm 51 is turned, the first hold arm 51 is moved in the inward direction of the turn table 55 and, therefore, the turn radius of the first hold arm 51 is reduced. In this manner, when the first hold arm 51 is turned, the first hold member 53 is prevented from butting against the rough grindstone holder stored in the working tool storage portion 65C. Also, since the turn radius of the first hold arm 51 is small, not only there can be lowered a danger that the rough grindstone holder 30 held by the first hold member 53 can be dropped off the first hold member 53, but also energy necessary to turn the first hold arm 51 can be reduced. Further, because the second hold arm 52 is opened and is also moved in the inward direction of the turn table 55, similarly to the first hold arm 51, the second hold arm 52 is prevented from butting against the rough grindstone holder that is stored in the working tool storage portion 65C. In case where the first hold arm 51 reaches the position of the first working tool storage portion 65A, as shown by a solid line in FIG. 13A, the first hold member 53 is closed to thereby hold the grip portion 32 of the rough grindstone holder 30 (S2).

After the grip portion 32 of the rough grindstone holder 30 is held, the vertically moving base 62 is moved up to a position shown by a solid line in FIG. 12A by a vertically moving cylinder (not shown) disposed in the automatic tool replacement device 2. Due to the upward movement of the vertically moving base 62, the first hold arm 51 holding the rough grindstone holder 30 is moved upward and the rough grindstone holder 30 is pulled out from the first working tool storage portion 65A(S3). On the other hand, the second hold arm 52 holds nothing and the hold member 54 remains opened. Next, by operating the first moving base 56 of the rodless cylinder, as shown by a virtual line in FIG. 12A, the first hold arm 51 is moved inwardly in the radial direction of the turn table 55 (S4). Then, as shown by a solid line in FIG. 12B, by turning the turn table 55, the first hold arm 51 is moved up to a position which corresponds to the spindle 10 (S5). Further, as shown by a solid line in FIG. 13B, the first moving base 56 is fully moved outwardly in the radial direction of the turn table 55, so that the rough grindstone holder 30 held by the first hold member 53 is positioned just below the spindle 10 in the grinding portion 1 (S6).

Figure 12B:
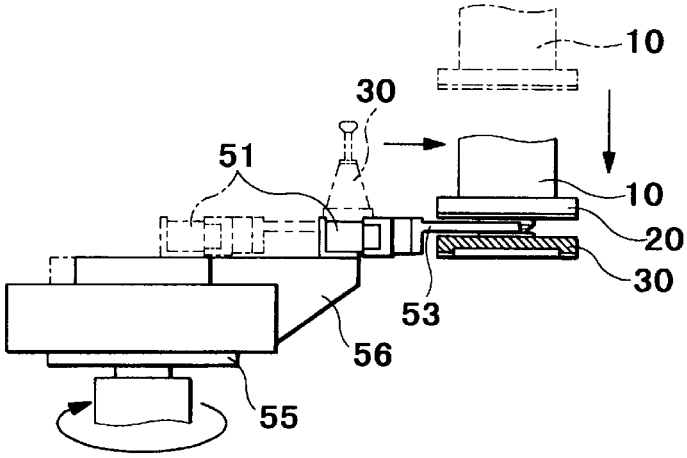

When the rough grindstone holder 30 is positioned just below the spindle 10, as shown by a solid line in FIG. 12B, the spindle 10 is then moved down by the spindle vertically moving device 11 (S7). In case where the spindle 10 is moved downward, the shank portion 31 of the rough grindstone holder 30 is inserted into the tool mounting portion 25 formed in the spindle 10, so that the back surface 32A of the grip portion 32 of the rough grindstone holder 30 can be soon contacted with the surface 25A (FIG. 7) of the tool mounting portion 25. In case where the back surface 32A of the grip portion 32 of the rough grindstone holder 30 is contacted with the surface 25A of the tool mounting portion 25, the draw bar 26 is pulled and the pull stud 35 of the rough grindstone holder 30 is restricted by the clamp mechanism 28 to thereby clamp the rough grindstone holder 30 (S8). In this manner, the rough grindstone holder 30 is fixedly mounted into the tool mounting portion 25 of the spindle 10.

During the above process, to the rotary table 42 of the vacuum hold and rotate apparatus 40, there is delivered the silicone wafers, which is a member to be worked (that is, a member to be ground), by a robot arm (not shown). In case where the silicone wafer S is delivered to and placed onto the rotary table 42, negative pressures are applied respectively from the vacuum attracting holes 42*a*, 42*a*, - - - , which are formed in the rotary table 42, to the silicone wafer S by air pump (not shown), so that the silicone wafer S can be vacuum attracted to the rotary table 42.

Figure 12C:
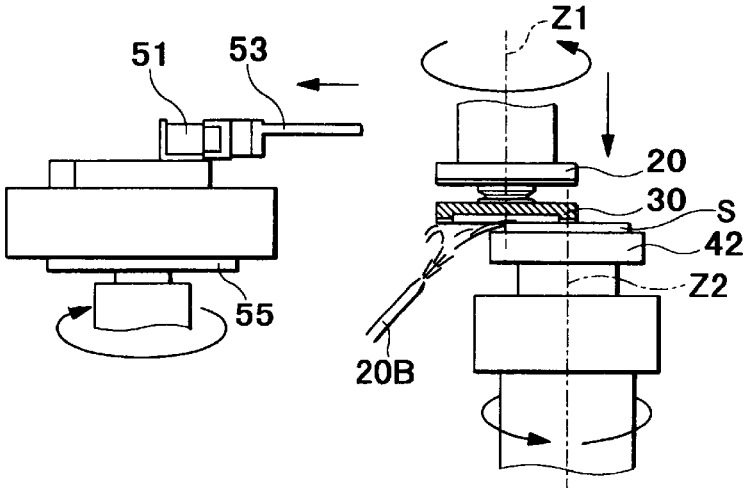
Figure 13A:
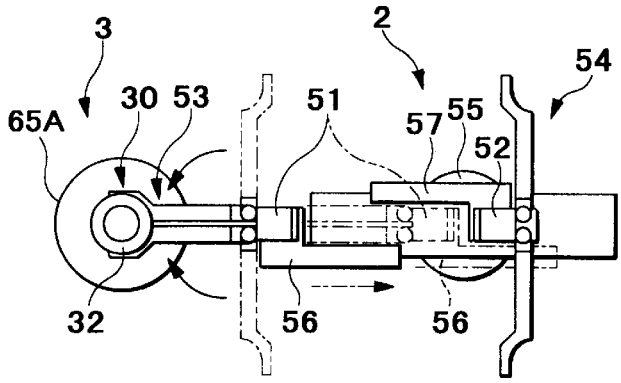
FIGS. 13A to 13C are plan views of the one-surface grinding apparatus, showing the above process including the step of mounting a rough grindstone member into the tool mounting portion of a spindle up to the step of starting a rough grinding operation using the rough grindstone member.
Figure 13B:
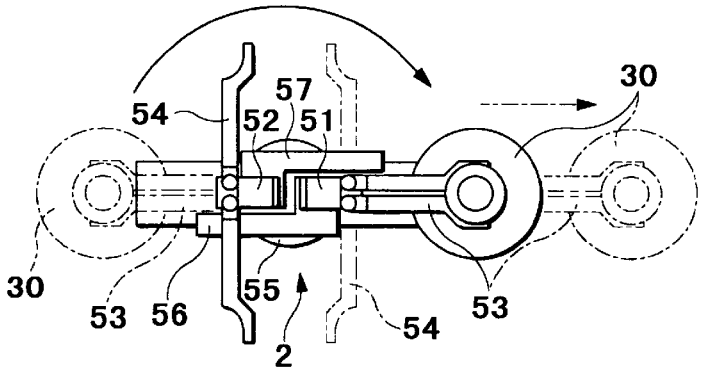
Figure 13C:
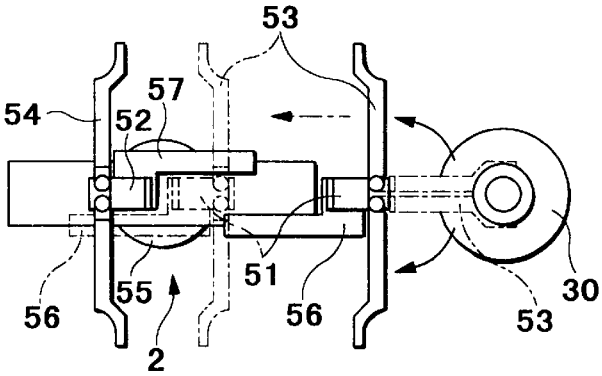

Also, after the rough grindstone holder 30 is clamped by the clamp mechanism 28, as shown by a virtual line in FIG. 13C, the first hold member 53 is opened to thereby release the rough grindstone holder 30 (S9). Next, as shown by a virtual line in FIG. 13C, the moving base 56 is moved inwardly of the turn table 55 and the first hold arm 51 is thereby moved inwardly, so that the first hold arm 51 is moved back (S10). In case where the first hold arm 51 is moved back, as shown in FIG. 12C, the housing 10A and spindle 10 are moved down to a position where the lower surface of the rough grindstone 34 of the rough grindstone holder 30 can be contacted with the surface of the silicone wafer S serving as a member to be worked (that is, a member to be ground) which is vacuum held by the vacuum hold and rotate apparatus 40 (S11). After the spindle 10 is moved down, the spindle motor 10B is driven to thereby rotate the spindle 10 around the vertical shaft Z1 and, at the same time, the motor 43 is driven to thereby rotate the rotary table 42 around the vertical shaft Z2, so that an operation to roughly grind one surface of the silicone wafer S can be started (S12). At the then time, the working Liquid is jetted out from the nozzle 20B (FIG. 5) to the rough grindstone 34 of the rough grindstone holder 30.

Through the above process, when the rough grindstone holder 30 is mounted onto the tool mounting portion 25 and the rough grinding operation by the rough grindstone holder 30 is completed, the rough grindstone holder 30 is replaced with the second rough grindstone holder 30' differing in roughness from the rough grindstone holder 30 and the silicone wafer S is roughly ground again by the second rough grindstone holder 30'.

Figure 14:
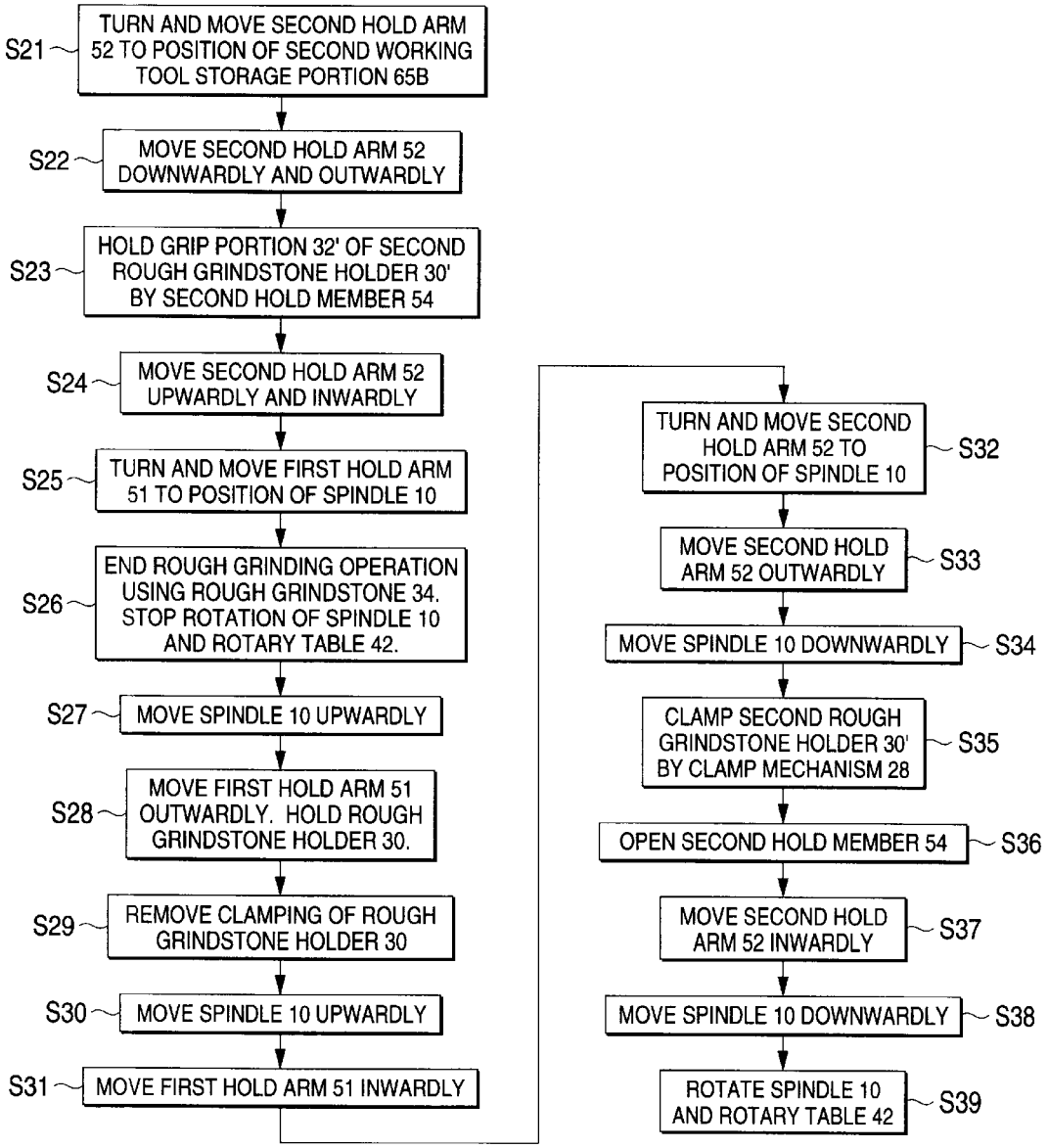
FIG. 14 is a flow chart of a process including the step of replacing the rough grindstone holder with a second grindstone holder up to the step of executing a rough grinding operation using the second grindstone holder.
Figure 15A:
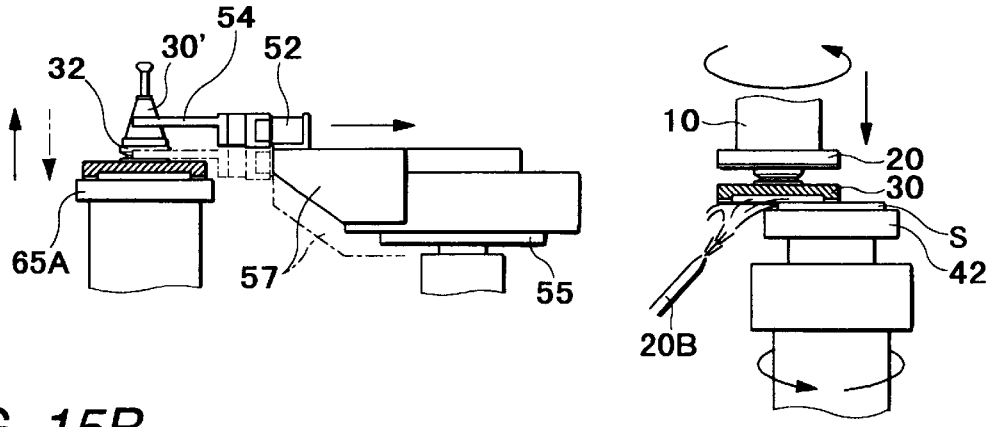
FIGS. 15A to 15C are plan views of the one-surface grinding apparatus, showing the above process including the step of replacing the rough grindstone holder with a second grindstone holder up to the step of executing a rough grinding operation using the second grindstone holder.
Figure 15B:
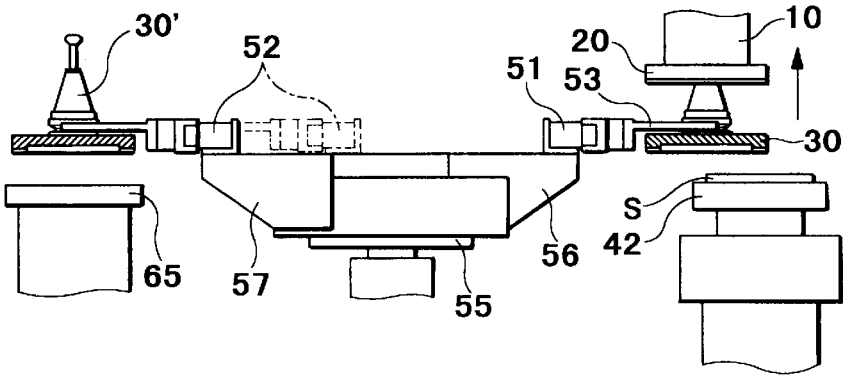
Figure 15C:
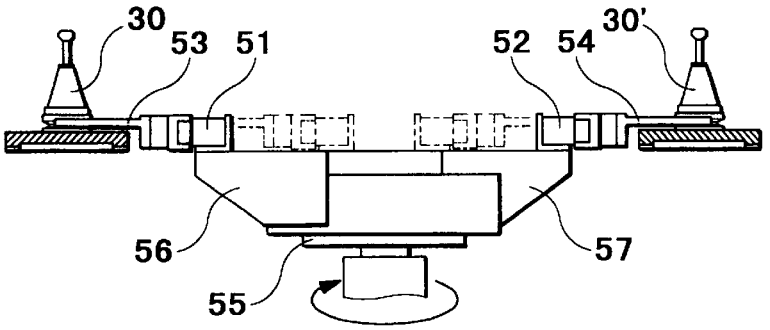

Next, description will be given below of a process including the step of replacing the rough grindstone holder 30 with the second rough grindstone holder 30' up to the step of executing a rough grinding operation using the second rough grindstone holder 30' with reference to a flow chart of the present process shown in FIG. 14 as well as the views of the one surface grinding apparatus M shown in FIGS. 15A to 15C, respectively showing the steps to be executed by the one surface grinding apparatus M.

While the rough grinding operation by the rough grindstone holder 30 is being executed in the grinding portion 1, in the automatic tool replacement device 2, in order to be able to replace the rough grindstone holder 30 with the second rough grindstone holder 30' quickly, the second rough grindstone holder 30' has been held by the hold member 54 of the second hold arm 52. Thus, firstly, the second hold arm 52 is turned and moved to the position of the second working tool storage portion 65B in which the second rough grindstone holder 30' within the grindstone stocker 3 is stored (S21). Next, the second hold arm 52 is moved down and is thereby moved outwardly in the radial direction of the turn table 55 (S22). After then, as shown by a virtual line in FIG. 15A, the second hold member 54 is closed to thereby hold the grip portion 32 of the second rough grindstone holder 30' (S23). In case where the grip portion 32 of the second rough grindstone holder 30' is held in this manner, as shown in FIG. 15A, the second hold arm 52 is moved up and is thereby moved inwardly in the radial direction of the turn table 55 (S24). Due to this process, the second rough grindstone holder 30' is held by the second hold arm 52. In case where the second rough grindstone holder 30' is held by the second hold arm 52, the first hold arm 51 is turned and moved to the position of the spindle 10 (S25). After then, the one surface grinding apparatus M waits for completion of the rough grinding operation by the rough grindstone holder 30.

After then, in case where the rough grinding operation by the rough grindstone holder 30 is completed, the rotational movements of the spindle 10 and rotary table 42 are caused to stop (S26). Thus, after completion of the rough grinding operation by the rough grindstone holder 30, as shown in FIG. 15B, the spindle 10 is moved upwardly until the grip portion 32 of the rough grindstone holder 30 mounted on the tool mounting portion 25 of the spindle 10 is set almost at the same position as the first hold arm 51 (S27). In case where the grip portion 32 of the rough grindstone holder 30 is set almost at the same position as the first hold arm 51, the first hold arm 51 is moved outwardly in the radial direction of the turn table 55 and the first hold member 53 is closed to thereby hold the grip portion 32 of the rough grindstone holder 30 (S28). After the first hold member 53 holds the grip portion 32 of the rough grindstone holder 30 in this manner, the draw bar 26 of the spindle 10 is pushed out downward to release the pull stud 35 of the rough grindstone holder 30, thereby removing the clamped state of the rough grindstone holder 30 by the clamp mechanism 28 (S29). After removal of the clamped state of the rough grindstone holder 30, the spindle 10 is moved up (S30) and the rough grindstone holder 30 is pulled out from the tool mounting portion 25. Further, the first hold arm 51 is moved inwardly in the radial direction of the turn table 55 (S31). After the first hold arm 51 is moved to thereby retreat the rough grindstone holder 30, the second hold arm 52 is turned and moved to the position of the spindle 10 to thereby move the second rough grindstone holder 30' to a position which corresponds to the spindle 10 (S32). Then, as shown in FIG. 15C, the second hold arm 52 is moved outwardly in the radial direction of the turn table 55 (S33) and the second rough grindstone holder 30' is moved to a position just below the spindle 10. After then, the spindle 10 is moved downward (S34) and the shank portion 31 of the second rough grindstone holder 30' is inserted into the tool mounting portion 25 of the spindle 10. After the shank portion 31 is inserted into the tool mounting portion 25, the pull stud 35 of the second rough grindstone holder 30' is pulled to thereby allow the clamp mechanism 28 to clamp the second rough grindstone holder 30'.

In case where the second rough grindstone holder 30' is clamped, the second hold member 54 is opened (S36), so that the second hold member 54 releases the second rough grindstone bolder 30'. After release of the second rough grindstone holder 30', the second hold arm 52 is moved inwardly in the radial direction of the turn table 55 (S37). Next, as shown in FIG. 15C, the spindle 10 is moved downward (S38) and the lower surface of the rough grindstone 34 held by the second rough grindstone holder 30' is brought into contact with the surface of the silicone wafer S. And, by driving the spindle motor 10B, the spindle 10 is rotated around the vertical axis Z1 and the rotary table 42 is rotated around the vertical axis Z2, thereby starting a rough grinding operation using the second grindstone holder 30' (S39).

Though the above process, in case where the second grindstone holder 30' is mounted into the tool mounting portion 25 and a given rough grinding operation by the second grindstone holder 30' is then completed, the second grindstone holder 30' is removed from the tool mounting portion 25, and a finish grinding operation by the finishing grindstone member 20 is executed. When executing the finish grinding operation using the finishing grindstone member 20, in order to prevent the tool mounting portion 25 from being soiled with cut powder and grinding liquid, the cover member 36 is mounted onto the tool mounting portion 25; that is, the tool mounting portion 25 is covered with the cover member 36 to thereby protect the tool mounting portion 25 against soil.

Figure 16:
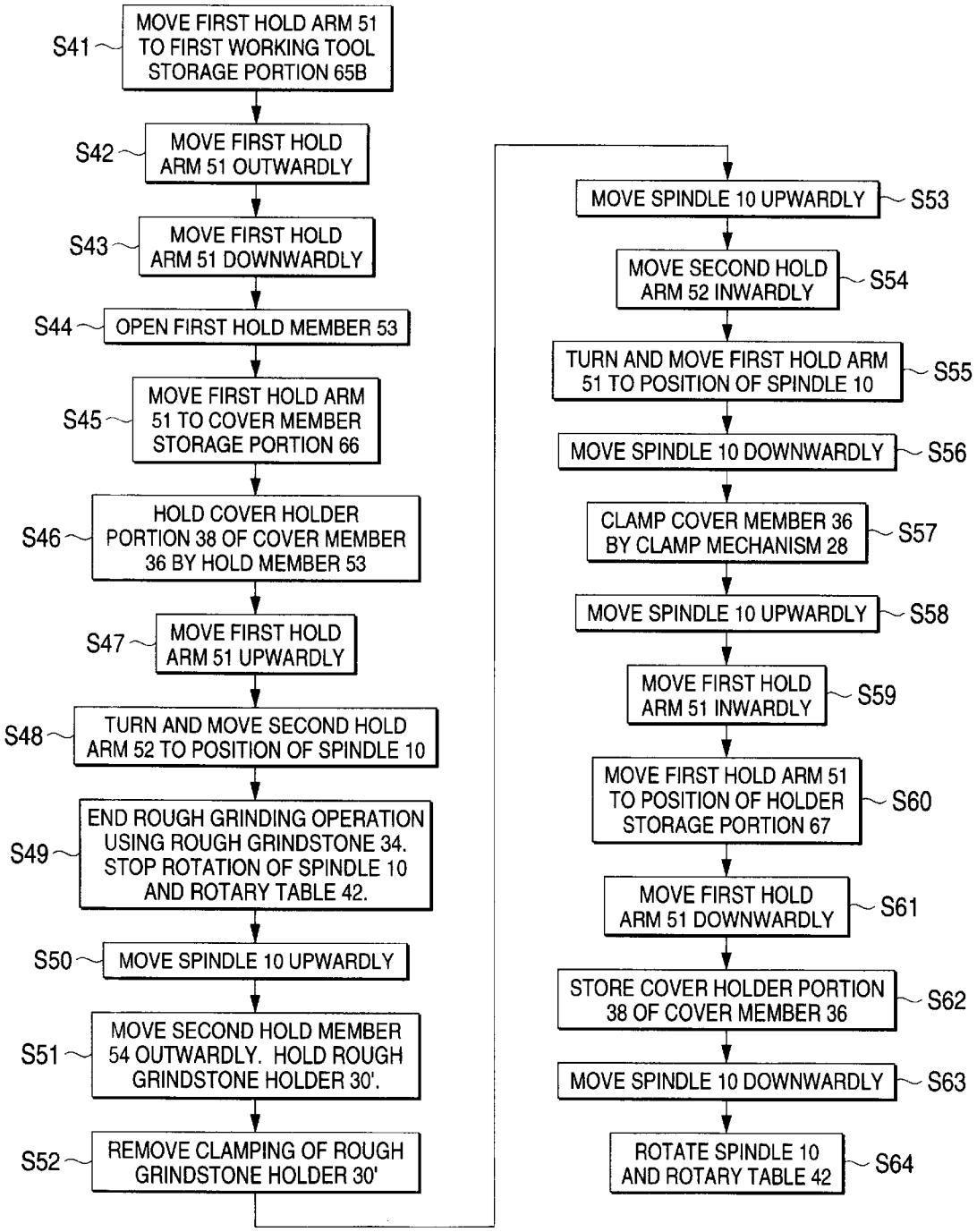
FIG. 16 is a flow chart of a process including the step of executing a rough grinding operation using the second rough grindstone holder up to the step of executing a finish grinding operation using a finishing grindstone member.
Figure 17A:
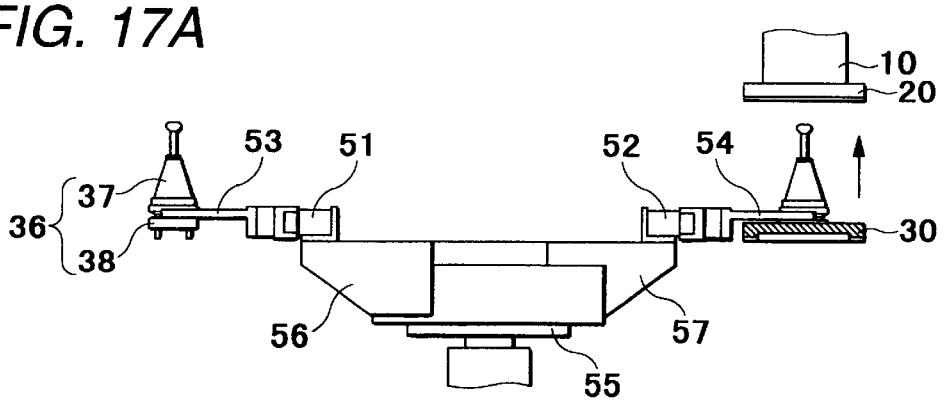
FIGS. 17A to 17C are side views of the one-surface grinding apparatus, showing the above process including the step of executing a rough grinding operation using the second rough grindstone holder up to the step of executing a finish grinding operation using a finishing grindstone member.
Figure 17B:
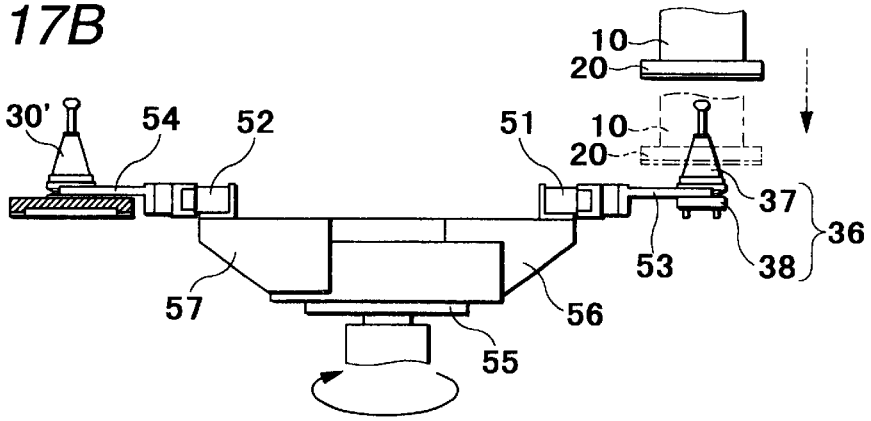
Figure 17C:
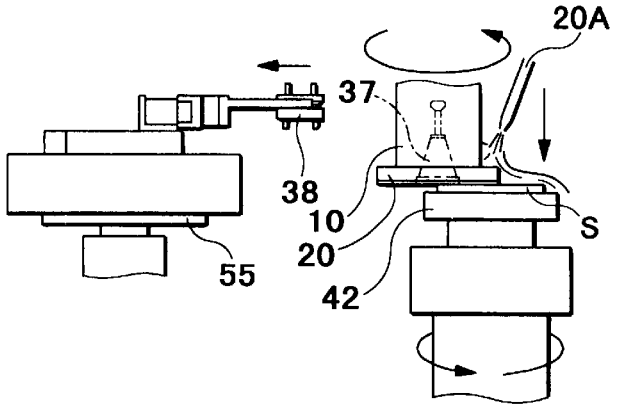

Next, description will be given below of a process to be executed by the one surface grinding apparatus M in which the second grindstone holder 30' is removed from the tool mounting portion 25, the cover member 36 is mounted onto the tool mounting portion 25 and the finish grinding operation is executed using the finishing grindstone member 20, with reference to FIG. 16 which is a flow chart of the process as well as FIGS. 17A to 17C which are views of the one surface grinding apparatus M, respectively showing the steps of the process.

While the rough grinding operation by the second grindstone holder 30' is being executed in the grinding portion 1, in the automatic tool replacement device 2, the cover member 36 is held by the first hold member 53 of the first hold arm 51 so that the second rough grindstone holder 30' can be removed from the tool mounting portion 25 and the cover member 36 can be mounted onto the tool mounting portion 25. However, in the first hold member 53, there is still being held the rough grindstone holder 30 that was used in the previous rough grinding operation. Thus, firstly, the turn table 55 is turned to thereby move the rough grindstone holder 30 to a position which corresponds to the first working tool storage portion 65A of the grindstone stocker 3 (S41). After the rough grindstone holder 30 is moved to the position corresponding to the first working tool storage portion 65A, the first hold arm 51 is moved outwardly in the radial direction of the turn table 55 (S42) to thereby move the rough grindstone holder 30 to a position just above the first working tool storage portion 65A. When the rough grindstone holder 30 is positioned just above the first working tool storage portion 65A, the first hold arm 51 is moved downward (S43), and the rough grindstone holder 30 is stored into the first working tool storage portion 65A. Next, the first hold member 53 is opened (S44) to thereby release the grip portion 32 of the first rough grindstone holder 30. In this manner, the first rough grindstone holder 30 is stored into the first working tool storage portion 65A and thus the first hold member 53 turns out into a condition that it does not hold anything.

In case where the first hold member 53 turns out into a condition that it does not hold anything, with the first hold member 53 remaining opened, the first hold arm 51 is turned by the turn table 55 so that the first hold arm 51 is moved to the cover member storage portion 66 (S45). After the first hold arm 51 is moved to the cover member storage portion 66, the first hold member 53 is closed to thereby hold the cover holder portion 38 of the cover member 36 (S46). After the cover member 36 is held in this manner, as shown in FIG. 17A, the first hold arm 51 is moved upward (S47), so that the first hold arm 51 is moved inwardly in the radial direction of the turn table 55. In this manner, the cover member 36 is held by the first hold arm 51. After the cover member 36 is held by the first hold arm 51, the second hold arm 52 is moved to the position of the spindle 10 (S48). And, then the one surface grinding apparatus M waits for completion of the rough grinding operation using the second rough grindstone holder 30'.

After then, when the given rough grinding operation using the second rough grindstone holder 30' is completed, the rotational movements of the spindle 10 and rotary table 42 are caused to stop (S49). In case where the given rough grinding operation using the second rough grindstone holder 30' is completed in this manner, the spindle 10 is moved upward until the grip portion 32 of the second rough grindstone holder 30' mounted in the tool mounting portion 25 of the spindle 10 arrives substantially at the same height position as the first hold arm 51 (S50). After the spindle 10 is moved up to this position, the second hold arm 52 is moved outward in the radial direction of the turn table 55 to thereby close the second hold member 54, so that the grip portion 32 of the second rough grindstone holder 30' is held by the second hold member 54 (S51). In case where the grip portion 32 of the second rough grindstone holder 30' is held in this manner, the draw bar 26 of the spindle 10 is pushed out to thereby remove the clamping of the second rough grindstone holder 30' by the clamp mechanism 28 (S52). Next, as shown in FIG. 17A, the spindle 10 is moved upward (S53) and the rough grindstone holder 30 is pulled out from the tool mounting portion 25. Further, the second hold arm 52 is moved inwardly in the radial direction of the turn table 55 (S54). That is, in case where the second hold arm 52 is moved and the second grindstone holder 30' is retreated, the first hold arm 51 is turned and moved to the position of the spindle 10 and the cover member 36 is moved to a position which corresponds to the spindle 10 (S55). Then, as shown in FIG. 17B, the first hold arm 51 is moved outwardly in the radial direction of the turn table 55 (S54) and the cover member 36 is positioned just below the spindle 10. After then, as shown by a virtual line in FIG. 17B, the spindle 10 is moved downward (S56). Due to the downward movement of the spindle 10, the main body portion 37 of the cover member 36 is inserted into the tool mounting portion 25 formed in the spindle 10. After the main body portion 37 of the cover member 36 is inserted into the tool mounting portion 25, the draw bar 26 is pulled to thereby restrict the pull stud 39 of the cover member 36, so that the cover member 36 can be clamped by the clamp mechanism 28 (S57).

In case where the cover member 36 is clamped in this manner, the spindle 10 is moved upward again, so that not only the spindle 10 but also the main body portion 37 of the cover member 36 clamped by the clamp mechanism 28 are both moved upward. Although the main body portion 37 of the cover member 3 is moved upward, the cover holder portion 38 of the cover member 3 is still left held by the first hold member 53, so that the main body portion 37 and cover holder portion 38 of the cover member 36 are separated from each other. This cover holder portion 38 is not necessary in the finish grinding operation and, in case where the cover holder portion 38 is situated in the grinding portion 1, it interferes with the finish grinding operation; and, therefore, the cover holder portion 38 is then stored into the cover holder storage portion 67 which is formed in the grindstone stocker 3. Accordingly, as shown in FIG. 17C, the first hold arm 51 holding the cover holder portion 38 is moved inwardly in the radial direction of the turn table 55 (S59). After the first hold arm 51 is moved in this manner, the turn table 55 is turned to thereby move the first hold arm 51 to the position of the cover holder storage portion 67 (S60). Next, the first hold arm 51, as it is, is moved downward (S61), and the cover holder portion 38 is left stored in the cover holder storage portion 67 (S62). In this manner, by keeping the cover holder portion 38 stored in the cover holder storage portion 67, the cover holder portion 38 can be prevented from dropping down from the first hold arm 51.

On the other hand, the spindle 10, with the main body portion 37 of the cover member 36 mounted on the tool mounting portion 25 thereof, is thereafter moved downward (S63), and the lower surface of the finishing grindstone 22 of the finishing grindstone member 20 is brought into contact with the surface of the silicone wafer S. And, the spindle 10 is rotated around the vertical axis Z1 and the rotary table 42 is rotated around the vertical axis Z2, thereby starting a finish grinding operation using the finishing grindstone member 20 (S64). While the finish grinding operation is under execution, the working liquid is jetted out from the nozzle 20A to the finishing grindstone 22 through working liquid supply holes 21*a*, 21*a*, - - - respectively formed in the finishing grindstone member 20.

And, while the finish grinding operation is being executed in this manner, the cover holder portion 38 of the cover member 36 is stored in the cover holder storage portion 67 in such a manner that the cover holder portion 38 remains held by the first hold arm 51. After then, in case where the finish grinding operation is ended, the whole process for grinding the surface of the silicone wafer S is completed. Next, description will be given below of the process covering the step of executing the finish grinding operation on the surface of the wafer S using the finishing grindstone member 20 up to the step of completing the grinding process with reference to a flow chart shown in FIG. 18.

Figure 18:
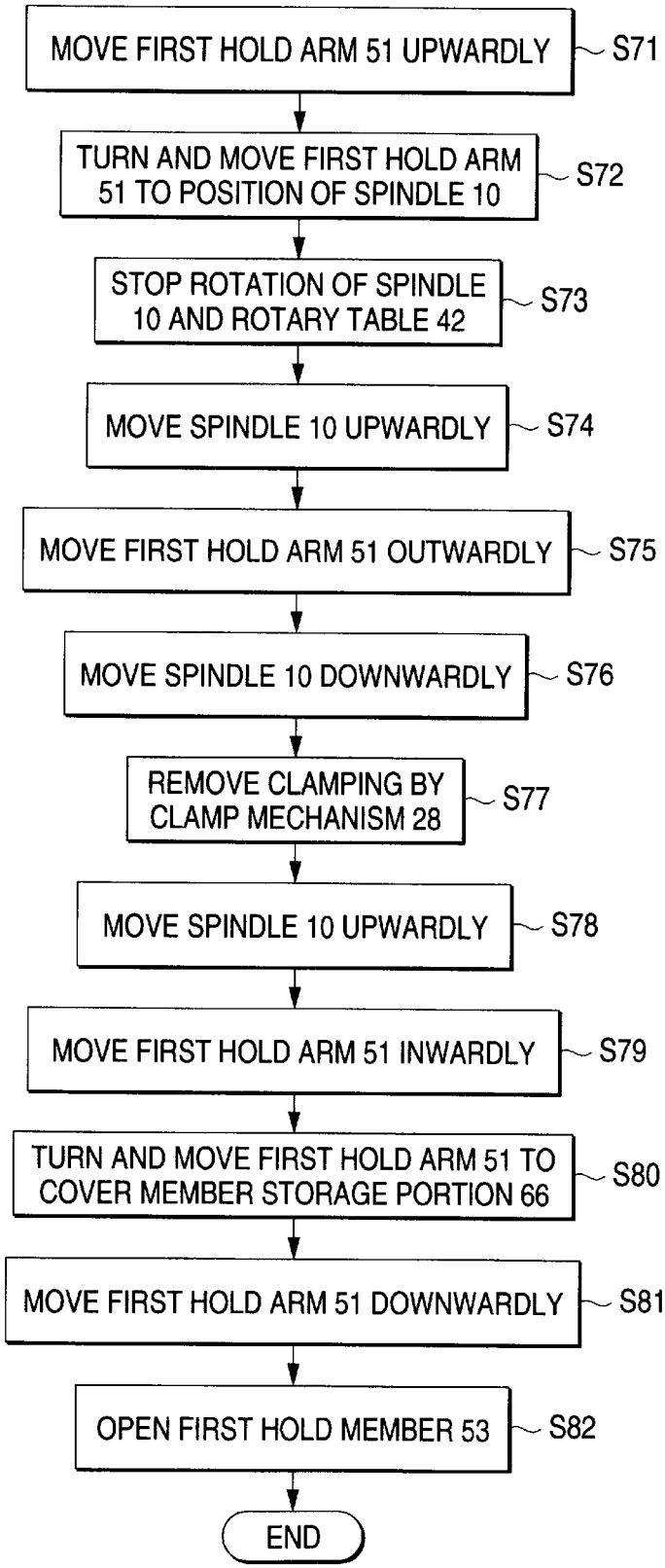
FIG. 18 is a flow chart of a process including the step of executing a finish grinding operation using the finishing grindstone member up to the step of completing the finish grinding operation.

As shown in FIG. 18, in case where the finish grinding operation using the finishing grindstone member 20 is ended, the cover holder portion 38 of the cover member 36 is mounted onto the main body portion 37 of the cover member 36, and the main body portion 37 is then removed from the tool mounting portion 25. For this purpose, just before the finish grinding operation using the finishing grindstone member 20 is ended, the cover holder portion 38 is moved to the position of the spindle 10. Specifically, firstly, the first hold arm 51 holding the cover holder portion 38 is moved upward (S71), and the cover holder portion 38 is then taken out from the cover holder storage portion 67. After the cover holder portion 38 is then taken out from the cover holder storage portion 67, the turn table 55 is turned to thereby turn and move the first hold arm 51 to the position of the spindle 10 (S72). The grinding apparatus M waits for completion of the finish grinding operation by the finish grindstone member 20.

After then, in case where the finish grinding operation using the finishing grindstone member 20 is ended, the rotational movements of the spindle 10 and rotary table 42 are caused to stop (S73). And, in case where the rotational movements of the spindle 10 and rotary table 42 are stopped to thereby end the finish grinding operation, the spindle 10 is moved up to a position higher than the first hold arm 51 (S74). Next, the first hold arm 51 is moved outwardly in the radial direction of the turn table 55, and the cover holder portion 38 of the cover member 36 is positioned just below the main body portion 37 of the cover member 36 (S75). Then, the spindle 10 is moved downward (S76) and the main body portion 37 is mounted onto the cover holder portion 38 of the cover member 36. Next, by pushing out the draw bar 26 of the spindle 10, the restraint of the pull stud 39 is removed to thereby remove the clamping of the main body portion 37 of the cover member 36 by the clamp mechanism 28 (S77). On removal of such clamping, the spindle 10 is moved upward (S78) and the main body portion 37 of the cover member 36 is pulled out from the tool mounting portion 25 of the spindle 10. After then, the first hold arm 51 is moved inwardly in the radial direction of the turn table 55 (S79). Next, the turn table 55 is turned to thereby turn and move the first hold arm 51 to the position of the cover member storage portion 66 (S80). Further, in case where the first hold arm 51 is moved outwardly in the radial direction of the turn table 55 and the first hold arm 51 is moved downward, the cover holder portion 38 of the cover member 36 is inserted into the cover member storage portion 66 (S81). And, by opening the first hold member 53, the cover member 36 is stored into the cover member storage portion 66 (S81). After then, there are removed the negative pressures from the air pump (not shown) of the vacuum hold and rotate apparatus 40 provided in the grinding portion 1 to thereby destroy or remove the vacuum condition between the rotary table 42 and silicone wafer S, so that the silicone wafer S can be removed. And, the thus ground silicone wafer S is taken out by a robot arm (which is not shown, either) and is then delivered to a cleaning apparatus in which a process for cleaning the silicone wafer S is executed. This completes a series of the grinding steps ranging from the step of executing the rough grinding operation up to the step of executing the finish grinding operation.

Figure 19:
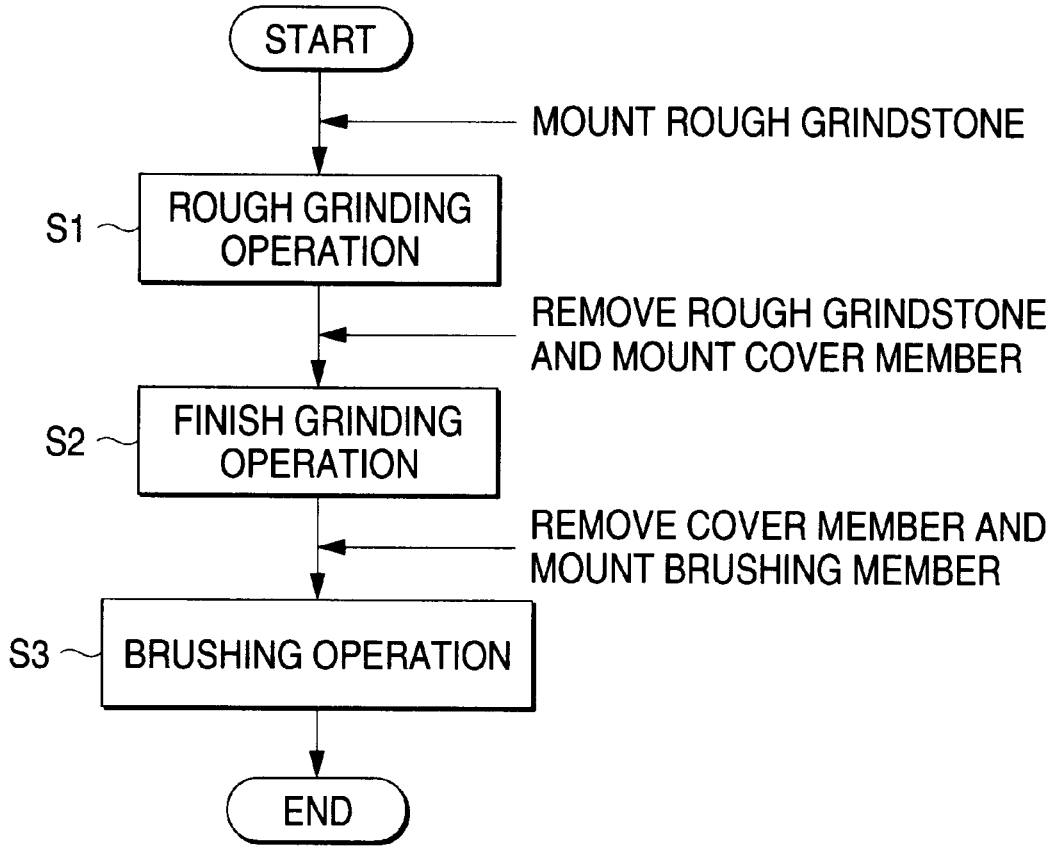
FIG. 19 is a flow chart of a process of the one-surface grinding apparatus including the step of executing a brushing operation.

Also, as shown in FIG. 19, after completion of the finish grinding operation, the finish ground surface of the silicone wafer S can also be brushed using a brushing member 70. In the case of the brushing operation using the brushing member 70, when removing the main body portion 37 of the cover member 36 mounted on the tool mounting portion 25, the grip portion 72 of the brushing member 70 is held by the second hold member 54 of the second hold arm 52. And, when the cover member 36 is held by the hold member 53 of the first hold arm 51 and is then stored into the cover member storage portion 66, the shank portion 71 of the brushing member 70 is mounted into the tool mounting portion 25. Then, the pull stud 75 of the brushing member 70 is restricted by the clamp mechanism 28 disposed in the spindle 10, so that the brushing member 70 can be clamped by the clamp mechanism 28.

Figure 20:
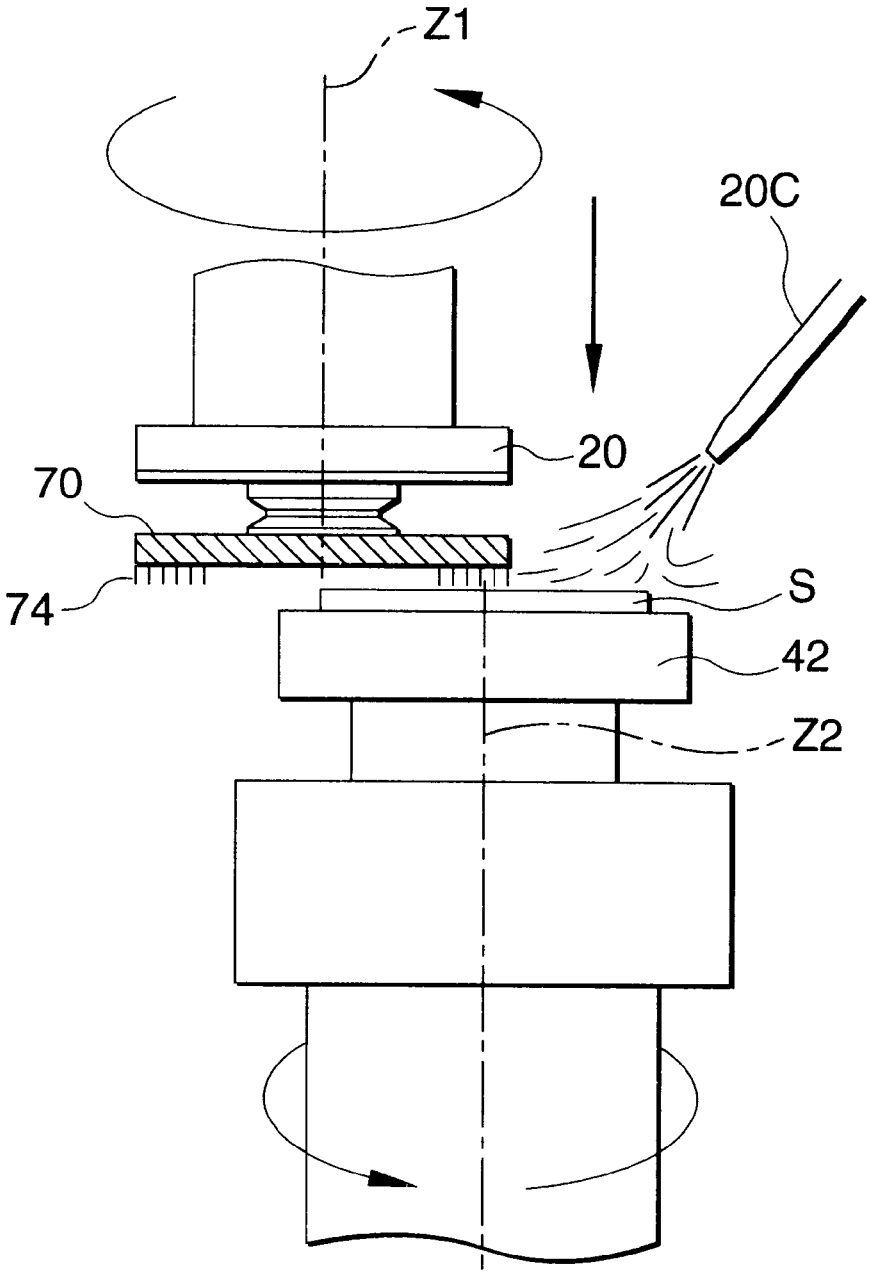
FIG. 20 is a side view of the one-surface grinding apparatus, showing the step of executing the brushing operation.

In this state, the second hold arm 52 is retreated and the spindle 10 is moved to thereby bring the grain-containing brush 74 of the brushing member 70 into contact with the above ground surface of the silicone wafer S. In this state, while rotating the spindle 10 and the silicone wafer S on the rotary table 42, a brushing processing can be performed on the surface of the silicone wafer S as shown in FIG. 20. At the then time, in order to enhance the effect of the brushing operation executed by the grain-containing brush 74, the brushing liquid is jetted or sprayed out from the nozzle 20C onto the ground surface of the silicone wafer S or onto the grain-containing brush 74. In case where the ground surface of the silicone wafer S is brushed using the grain-containing brush 74 in this manner, the ground surface of the silicone wafer S can be turned into a further higher-level surface which is free from the working distortion and is high in the deflective strength.

In case where the finish ground surface of the silicone wafer S is brushed using the grain-containing brush 74, for example, microcracks produced in the rough grinding step are prevented from developing, thereby being able to prevent the microcracks from damaging the surface of the silicone wafer S. Also, in case where the surface of the silicone wafer S is brushed using the grain-containing brush 74, when compared with the finishing grindstone 20, the surface roughness obtained is about half for the same grain size. Therefore, as the brushing effect, a further higher level surface state can be obtained.

Further, in case where this brushing processing is executed, due to the flexibility of the nylon threads N and the excellent grinding force of the diamond grains DM, the ground surface of the silicone wafer S can be turned into a further higher level surface which is free from working distortion and is enhanced in the deflective strength. Also, there are eliminated post-processing steps such as an etching step and a polishing step as well as chemicals. Further, the step of cleaning the surface of the worked member (silicone wafer S) can be facilitated.

Moreover, since the brushing member 70 holding the grain-containing brush 74 can be mounted into the tool mounting portion 25 of the spindle 10 using the hold arms 51, 52, an operator need not use enormous time and labor in mounting the brushing member into the tool mounting portion 25. Also, since the brushing operation using the grain-containing brush 74 does not require high precision, even in case where the grain-containing brush 74 is swung in a measure, the effect of the brushing operation cannot be lowered. Therefore, the grain-containing brush 74 can be properly mounted into the tool mounting portion 25 and thus can be used effectively.

Next, description will be given below of a second embodiment of a working apparatus according to the invention. In the present embodiment, as the working apparatus, there is used an edge grinding apparatus EM which is shown in FIGS. 21 and 22.

Figure 21:
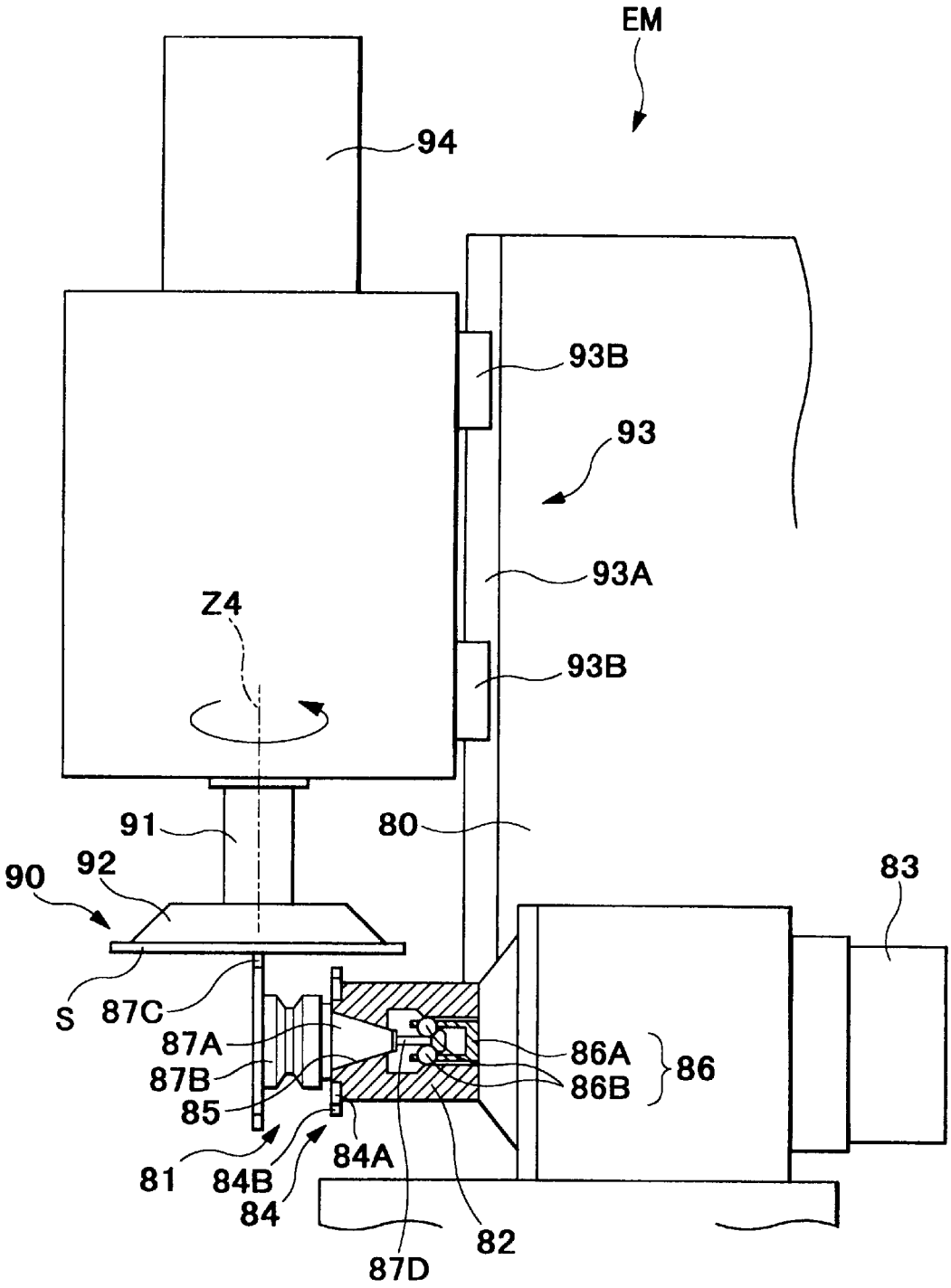
FIG. 21 is a front view of an edge grinding apparatus used as a working apparatus according to the invention.
Figure 22:
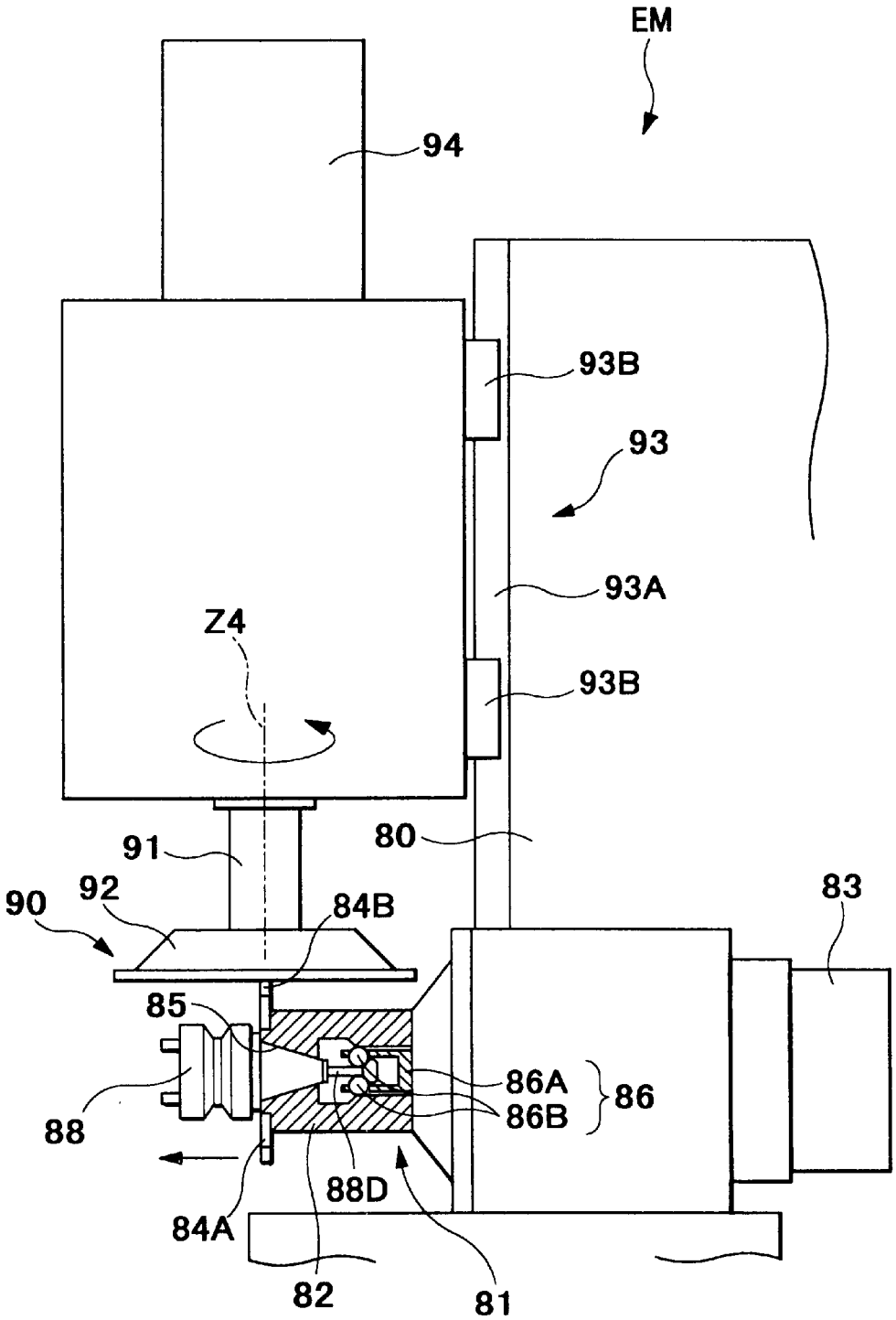
FIG. 22 is a front view of the edge grinding apparatus, showing a state in which a cover member is mounted onto the tool mounting portion of a spindle.

As shown in FIG. 21, the present edge grinding apparatus EM, which is used as a working apparatus according to the invention, includes a base 80 and, in the base 80, there is formed an edge grinding portion 81. Also, upwardly of the edge grinding portion 81, there is disposed a wafer hold apparatus 90 which is capable of attracting and holding a silicone wafer S consisting of a circular-shaped thin plate.

Figure 23A:
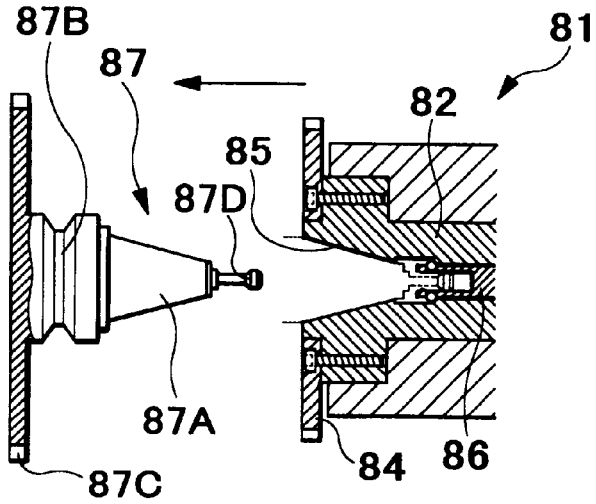
FIGS. 23A to 23C side views of the edge grinding apparatus, showing a grinding process to be executed by the edge grinding apparatus.
Figure 23B:
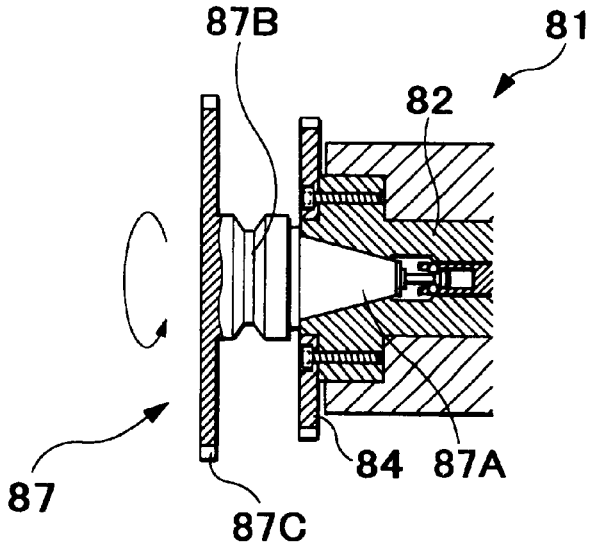
Figure 23C:
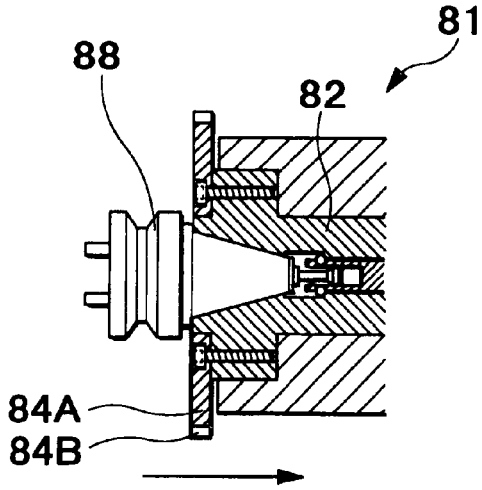

In the edge grinding portion 81, there is disposed a spindle 82 in such a manner that an axis thereof extends in the horizontal direction; and, in the rear of the spindle 82, there is disposed a motor 83 which is used to rotate the spindle 82. On the spindle 82, there is mounted a ring-shaped grindstone base 84A in such a manner that it is fixed to the spindle 82 by bolts B, B (FIGS. 23A to 23C). To this grindstone base 84A, there is fixed a disk-shaped finishing grindstone 84B. As the finishing grindstone 84B, there is used a fine grindstone having a mesh size of the order of #2000.

In the spindle 82, there is formed a tool mounting portion 85 consisting of a mounting hole which is concentric with the finishing grindstone 84B and is tapered. In the rear of the tool mounting portion 85, there is disposed a known pull-stud-clamp mechanism 86 which is composed of a draw bar 86A and balls 86B, 86B. And, the spindle 82 is arranged such that it can be moved in a direction along the rotation axis of the spindle 82 (in FIG. 21, in the right and left direction) as well as in a horizontal direction perpendicular to the rotation axis of the spindle (in FIG. 21, in a direction which penetrates the sheet thereof).

Also, when executing a rough grinding operation on the edge of the silicone wafer S, a rough grindstone holder 87 is mounted into the tool mounting portion 85. This rough grindstone holder 87 includes a tapered shank portion 87A which can be inserted into the tool mounting portion 85 and, in front of (in FIG. 21, on the left side of) the shank portion 87A, there is formed a grip portion 87B. Further forwardly of the grip portion 87B, there is disposed a disk-shaped rough grindstone 87C. As the rough grindstone 87C, there is used a rough grindstone having a mesh size, for example, of the order of #600. Moreover, in the rear of the shank portion 87A, there is disposed a pull stud 87D. And, in case where the rough grindstone holder 87 is inserted into the tool mounting portion 85 and is then fixed by the pull-stud-clamp mechanism 86, the pull stud 87D is pulled by the draw bar 86A with the balls 86B, 86B between them, so that the rough grindstone holder 87 is clamped by the tool mounting portion 85 and is thereby mounted at a given position.

Further, laterally of the spindle 82, there is disposed an automatic tool replacement device (not shown) which includes a hold arm. The hold arm of the automatic tool replacement device is structured such that it is capable of holding the grip portion 87B of the rough grindstone holder 87. As the automatic tool replacement device, there can be used an automatic tool replacement device in which the hold arms 51, 52 of the automatic tool replacement device 2 used in the first embodiment can be rotated around a horizontal axis extending in parallel to the rotation axis of the finish grindstone member 84 or rough grindstone holder 87. Thus, the description of the present automatic tool replacement device is omitted here.

Also, when carrying out a finish grinding operation using the finishing grindstone member 84, as shown in FIG. 22, a cover member 88 is mounted onto the tool mounting portion 85. This cover member 88 has a shape identical with an integrated body of the main body portion 37 and cover holder portion 38 of the cover member 36 used in the first embodiment shown in FIG. 6. And, the cover member 88 is given almost the same taper as the shank portion 87A of the rough grindstone holder 87 and thus the cover member 88 can be inserted into the tool mounting portion 85. In the rear of the cover member 88, there is mounted a pull stud 88D which is disposed in the rough grindstone holder 87 and is identical in shape with the pull stud 87D. Also, the cover member 88 includes a grip portion almost identical in shape with the grip portion 87B of the rough grindstone holder 87 and, therefore, the cover member 88 can be held by a hold arm which is disposed in an automatic tool replacement device (not shown)

Also, the wafer hold apparatus 90 includes a support shaft 91 which can be rotated around a vertical axis Z4. On the lower surface of the support shaft 91, there is disposed an attract pad 92 which is capable of vacuum attracting the silicone wafer S. In the lower surface of the attract pad 92, there are formed a plurality of air attract grooves (not shown); and, by turning the air attract grooves into negative pressures, the silicone wafer S can be attracted to and held on the lower surface of the attract pad 92. Also, the support shaft 91 includes a vertically moving mechanism 93. This vertically moving mechanism 93 includes a rail 93A and two sliders 93B; that is, in case where the two sliders 93B are slided along the rail 93A, the silicone wafer S attracted and held by the attract pad 92 through the support shaft 91 can be moved in the vertical direction. Further, upwardly of the vertically moving mechanism 93, there is disposed a motor 94 which is used to rotate the support shaft 91. By driving the motor 94, the support shaft 91 can be rotated, so that the attract pad 92 and the silicone wafer S attracted to and held by the attract pad 92 can be rotated around the vertical shaft Z4.

Now, description will be given below of the operation of the edge grinding apparatus EM having the above structure.

FIGS. 23A to 23C are side views of an edge grinding apparatus according to the present embodiment, respectively showing the steps of a process to be executed by the present edge grinding apparatus.

At the stage of execution of the edge grinding operation, the rough grindstone holder 87 is not mounted in the tool mounting portion 85 of the spindle 82. From this state, the rough grindstone holder 87 is held by a hold arm (not shown); and, as shown in FIG. 23A, the rough grindstone holder 87 is positioned in front of the tool mounting portion 85 and the spindle 82 is moved forward. In case where the spindle 82 is moved forward, the shank portion 87A of the rough grindstone holder 87 is inserted into the tool mounting portion 85. After the shank portion 87A of the rough grindstone holder 87 is inserted into the tool mounting portion 85, the pull stud 87D of the rough grindstone holder 87 is pulled by the draw bar 86A with the balls 86B, 86B between them to thereby clamp the rough grindstone holder 87, so that the rough grindstone holder 87 can be mounted into the tool mounting portion 85. After the rough grindstone holder 87 is mounted into the tool mounting portion 85, from the state of FIG. 23A, the spindle 82 is moved to the left until the end portion of the rough grindstone 87C is superimposed on the edge portion of the silicone wafer S when they are viewed from above, as shown in FIG. 23B.

In this state, the edge of the silicone wafer S is ground. When grinding the edge of the silicone wafer S, the spindle 82 is rotated to thereby rotate the rough grindstone 87C around a horizontal axis thereof. At the then time, the spindle 82 is moved back and forth repeatedly in the back-and-forth direction thereof and, in synchronization with the repetitive cycle of the spindle 82, a vertically moving member (not shown) of the wafer hold apparatus 90 is moved up and down repeatedly in the vertical direction thereof. By moving the spindle 82 and vertically moving member in this manner, the rough grindstone 87C is moved with respect to the silicone wafer S along the edge of the silicone wafer S. In this manner, the rough grinding operation of the grinding operation of the edge of the silicone wafer S is executed.

In case where the given rough grinding operation of the edge of the silicone wafer S is ended, the grip portion 87B of the rough grindstone holder 87 is held by the hold arm disposed in the automatic tool replacement device (not shown), the spindle 82 is retreated, and the rough grindstone holder 87 is removed from the tool mounting portion 85 of the spindle 82. After then, the hold arm is rotated to thereby position the cover member 88 at a position in front of the spindle 82 where the rough grindstone holder 87 was present.

And, the spindle 82 is moved forward to thereby insert the cover member 88 into the tool mounting portion 85 of the spindle 82. In case where the cover member 88 is inserted into the tool mounting portion 85, the draw bar 86A is pulled to thereby clamp the cover member 88 with the pull stud 88D of the cover member 88 interposed between them. After the cover member 88 is clamped, the hold arm of the automatic tool replacement device is retreated so that the hold arm is moved to a position where the hold arm does not interfere with a finish grinding operation.

In this state, similarly to the rough grinding operation, the spindle 82 is rotated to thereby rotate the finish grindstone member 84 around a horizontal axis thereof. At the then time, the spindle 82 is moved back and forth repeatedly in the back-and-forth direction thereof and, in synchronization with the repetitive cycle of the spindle 82, the vertically moving member of the wafer hold apparatus 90 is moved up and down repeatedly in the vertical direction thereof. In this manner, the finish grinding operation of the edge of the silicone wafer S is executed. This completes the whole process for grinding the edge of the silicone wafer S.

In the foregoing description, there has been illustrated the process in which the rough grinding operation and finish grinding operation are executed once each. However, in some cases, depending on the manufacturing conditions of the silicone wafer S, the rough grinding operation is executed twice or more. For example, firstly, a rough grinding operation is executed using a rough grindstone having a large mesh size of the order of #600 and, next, another rough grinding operation is executed using a rough grindstone having a medium mesh size of the order of #1200. After then, a finish grinding operation may be executed using a finishing grindstone having a mesh size of the order of #2000.

Figure 24B:
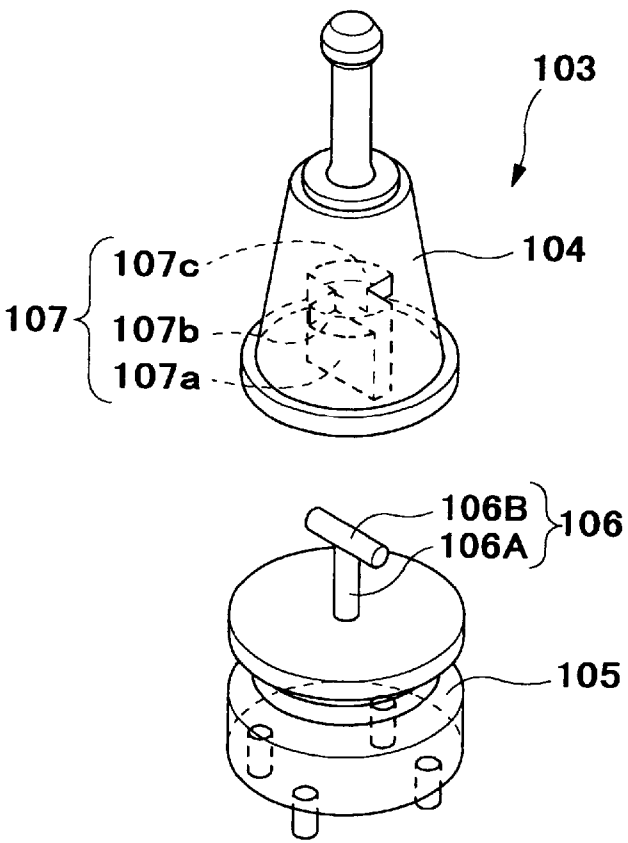
FIGS. 24A and 24B are both exploded perspective views of another embodiments of a cover member for use in the invention.
Figure 24A:
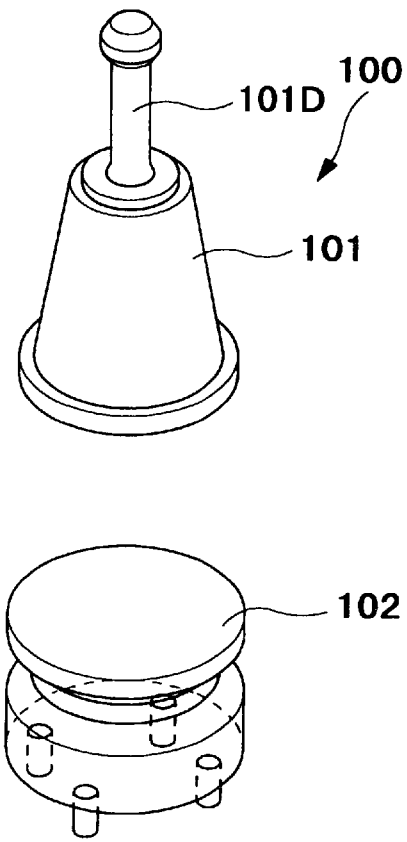

Also, as the cover member, there can be used not only the cover member used in the first embodiment but also, as a modified version thereof, a cover member which is shown in FIGS. 24A and 24B.

Now, FIGS. 24A and 24B are respectively exploded perspective views of another embodiments of a cover member for use in the invention.

A cover member 100 shown in FIG. 24A includes a main body portion 101 and a cover holder portion 102. Also, in the rear end portion of the main body portion 101, there is disposed a pull stud 101D which can be restricted by the clamp mechanism 28 (FIG. 2) of the spindle 10. The main body portion 101 is made of material such as iron which can be attracted by a magnet, whereas the cover holder portion 102 is composed of a magnet which can generate a magnetic force to attract the main body portion 101. Also, the cover holder portion 102 composed of a magnet is formed of, for example, an electromagnet and is arranged such that it is able not only to generate a magnetic force but also to extinguish the same. In the cover member 100, when mounting the main body portion 101 onto the tool mounting portion 25 shown in FIG. 7, in case where the cover holder portion 102 is held by the hold arm 51 (52) of the automatic tool replacement device 2, the main body portion 101 is attracted due to a magnetic force given from the cover holder portion 102. And, when the main body portion 101 is inserted into the tool mounting portion 25, in case where the magnetic force from the cover holder portion 102 is extinguished, the cover holder portion 102 can be removed from the main body portion 101.

Also, a cover member 103 shown in FIG. 24B includes a main body portion 104 and a cover holder portion 105. Also, at the position of the cover holder portion 105 that is present on the main body portion 104 side, there is disposed an engagement projection 106 which has a T shape when it is viewed from the side surface thereof and is used to prevent the cover holder portion 105 against removal from the main body portion 104. The engagement projection 106 is composed of a longitudinal axis portion 106A extending at right angles to the surface of the cover holder portion 105, and a transverse axis portion 106B extending at right angles to the longitudinal axis portion 106A. Also, in the surface of the main body portion 104 that is contacted with the cover holder portion 105, there is cut formed an engagement hole 107 into which the engagement projection 106 can be fitted. Referring to the structure of this engagement hole 107, there is cut formed a narrow and long engagement portion 107*a* extending in the depth direction of the main body portion 104 and, in the terminal end of the engagement portion 107*a*, there are formed fit-in portions 97*b*, 97*c* each of which has a fan-like shape when it is viewed from above. The length of the opening of the engagement portion 107*a* is set slightly larger than the transverse axis portion 106B of the engagement projection 106, while the length of the engagement portion 107*a* in the depth direction thereof is set almost equal to the longitudinal axis portion 106A of the engagement projection 106. When the engagement projection 106 is inserted into the deepest portion of the engagement portion 107*a* of the engagement hole 107, in case where the engagement-projection 106 is rotated about 90° with respect to the engagement portions 107*b*, 107*c*, the engagement projection 106 is allowed to reach the wall surfaces of the engagement portions 107*b*, 107*c*, so that the rotational movement of the engagement projection 106 can be thereby restricted and the engagement projection 106 can be prevented against removal in the axial direction thereof.

In the case of the cover member 103, when it is not mounted on the tool mounting portion 25 of the spindle 10, the engagement projection 106 provided in the cover holder portion 105 is fitted into the engagement hole 107 formed in the main body portion 104 and the cover holder portion 105 is thereby mounted on the main body portion 104. Also, to mount the cover member 103 onto the tool mounting portion 25, after the main body portion 104 is inserted into the tool mounting portion 25, while the cover holder portion 105 is being held by the hold arm 51 (52), the spindle 10 is rotated slightly. In response to the slight rotation of the spindle 10, the cover holder portion 105 is rotated with respect to the main body portion 104, so that the direction of the transverse axis portion 106B of the engagement projection 106 is allowed to be identical with that of the engagement portion 107*a* of the engagement hole 107. In this state, in case where the spindle 10 is moved upward, the engagement projection 106 is removed from the engagement hole 107. In this manner, the cover holder portion 105 can be separated from the main body portion 104.

Figure 25:
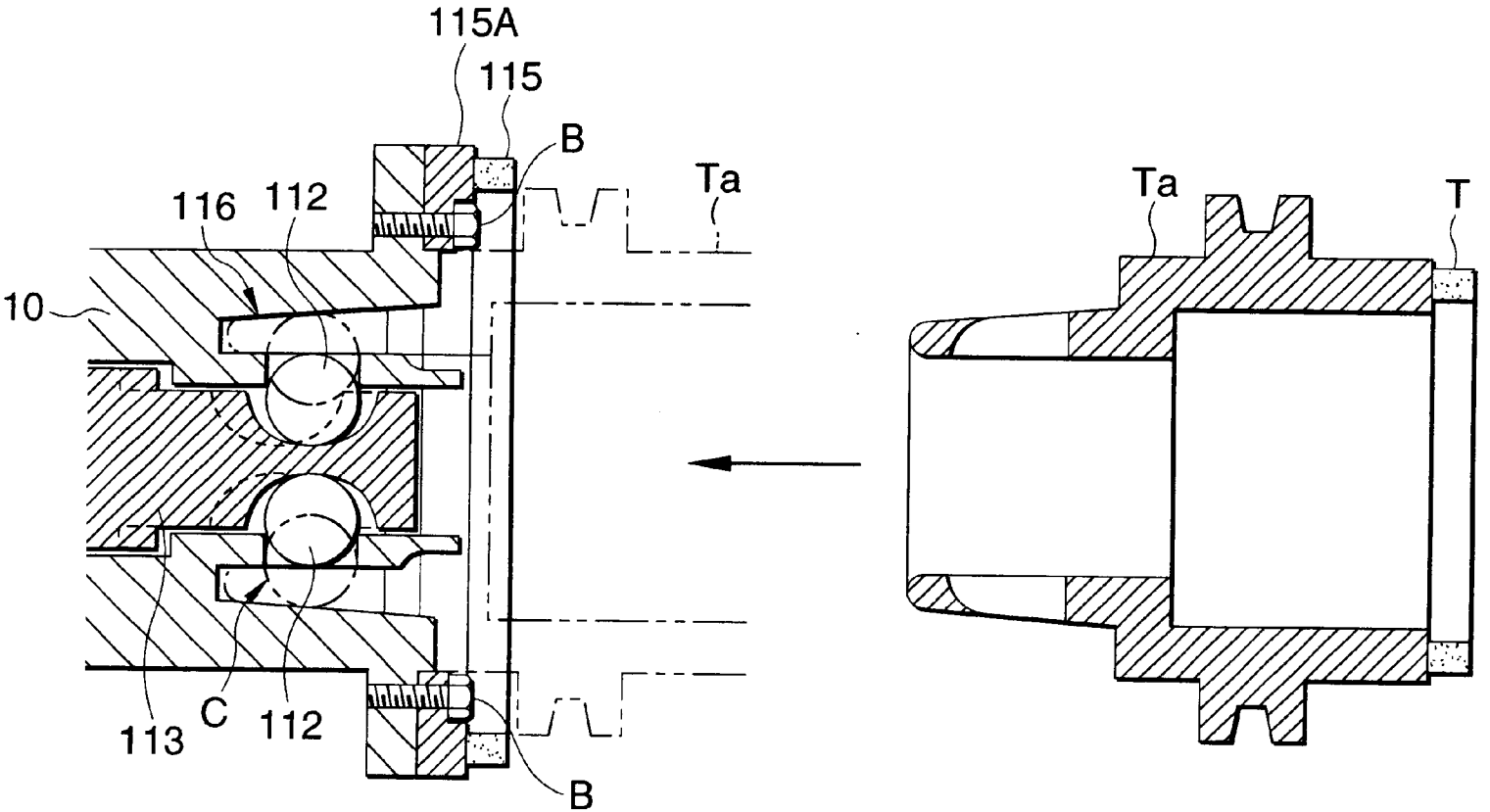
FIG. 25 is an enlarged sectional front view of a modification of a spindle fitted with a rough grindstone holder.

Further, the tool mounting portion 25 of the spindle 10 in the first embodiment can be modified as shown in FIG. 25.

To the leading end portion of the spindle 10, as shown in FIG. 25, there is fixed a finishing grindstone 115 serving as a finish working tool through its grindstone base 115A by bolts B, B. Further, in the leading end portion of the spindle 10 that is situated inwardly of the finishing grindstone 115, there is formed a tool mounting portion 6 into which a tool such as a rough grindstone T can be mounted in such a manner that it can be replaced through its holder portion Ta. The inner peripheral surface of the tool mounting portion 116 is formed tapered and the tool mounting portion 116 is disposed so as to be concentric with the finishing grindstone 115. In the interior portion of the tool mounting portion 116, there is provided a clamp mechanism C which is composed of balls 112 and a clamp rod 113. In case where the rough grindstone T is mounted into the tool mounting portion 116, the holder portion Ta of the rough grindstone T is clamped to the spindle 10 in a so called two-surface restricted manner by the inner peripheral surface of the tool mounting portion 116, balls 112 and clamp rod 113.

Next, description will be given of a machining center according to the invention with reference to FIGS. 26 and 27.

Figure 26:
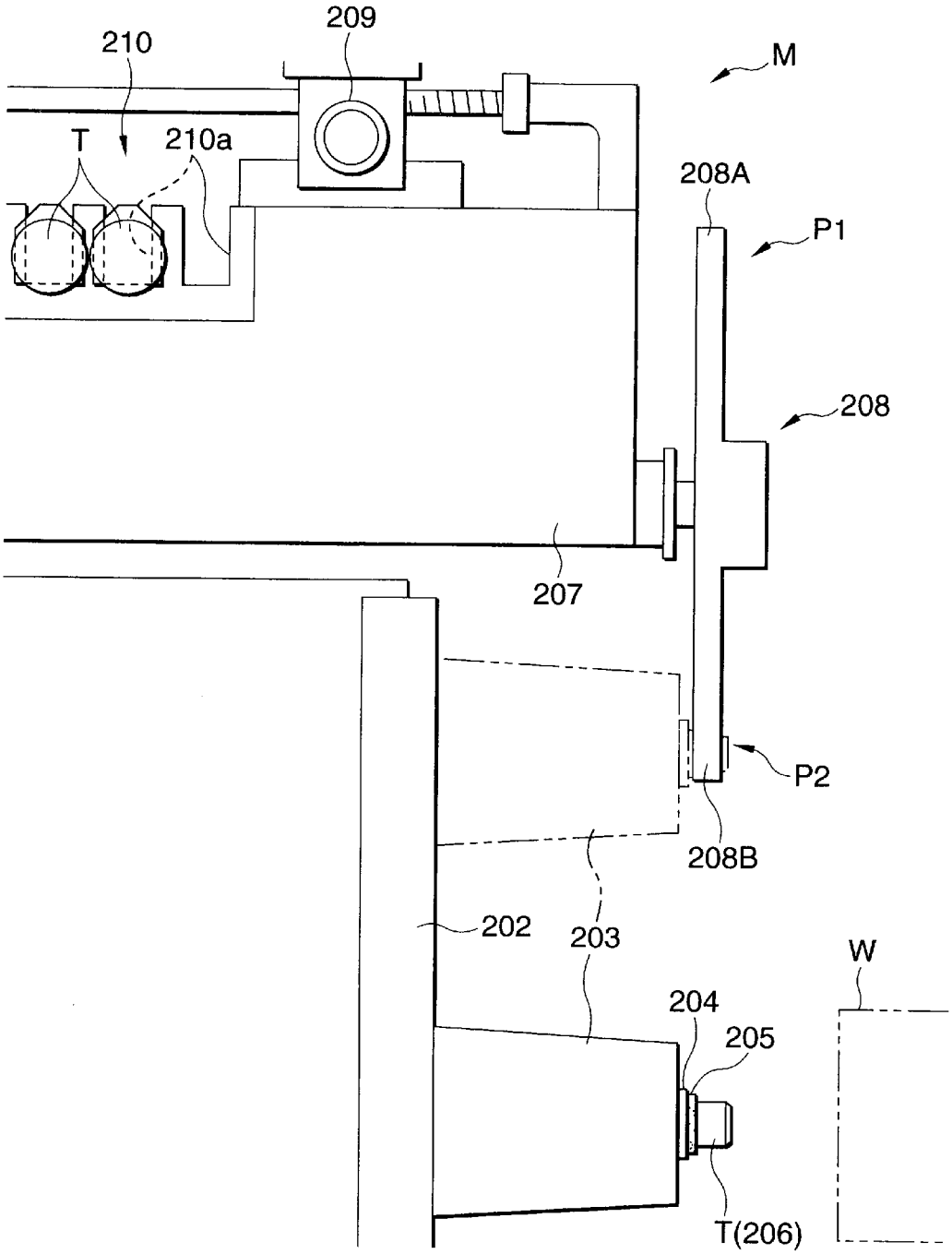
FIG. 26 is a side view of the neighboring portion of a spindle in a machining center according to the invention.
Figure 27:
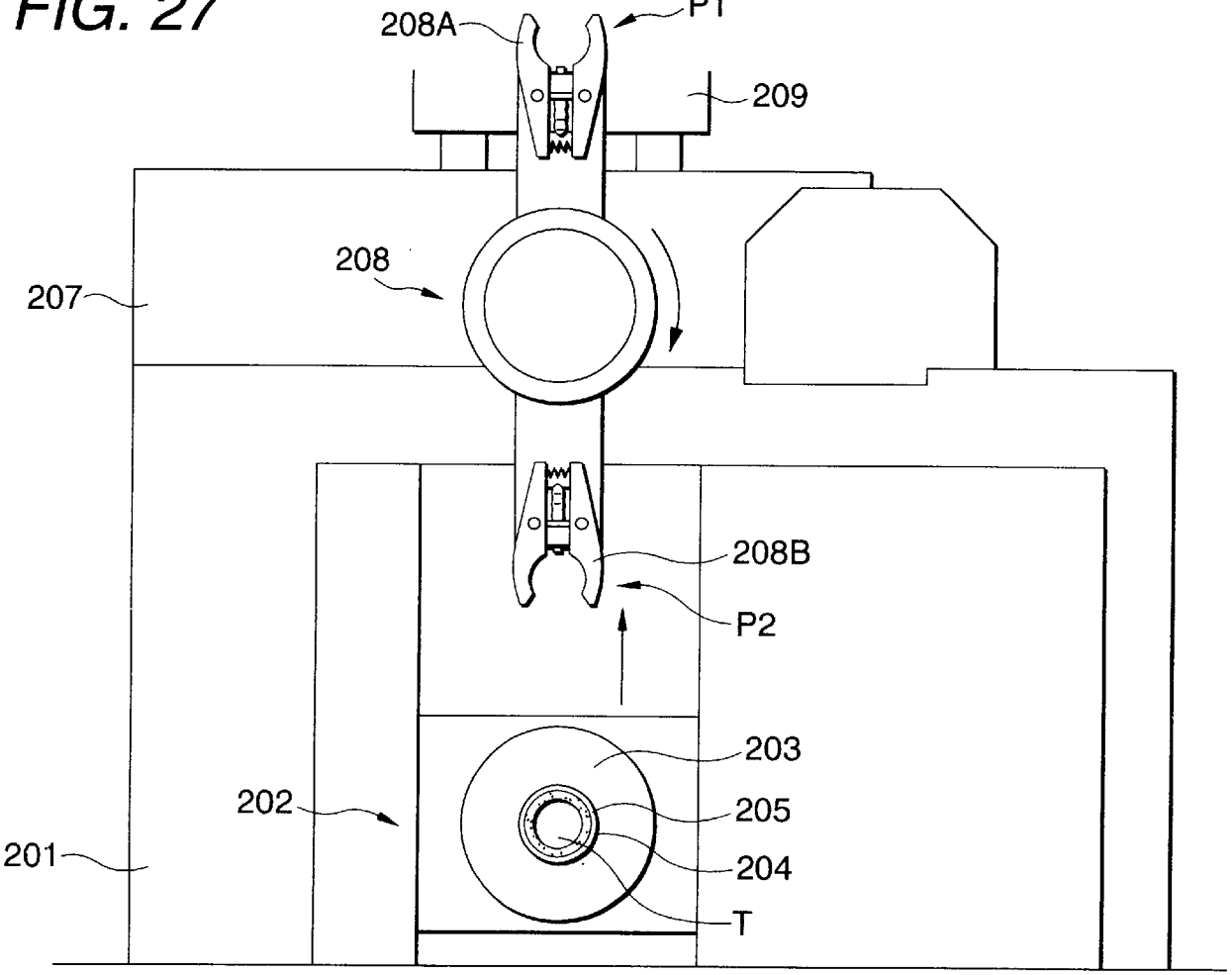
FIG. 27 is a front view of the machining center of FIG. 26 according to the invention.

As shown in FIG. 27, a machining center M includes a base 201. On this base 201, there is disposed a column 202 (which is shown in FIG. 26 as well) in such a manner that it can be moved back and forth as well as right and left; and, on the column 202, there is supported a spindle head 203 in such a manner that it can be moved up and down. Also, on the spindle head 203, there is disposed a spindle 204 in a rotatable manner. To the leading end portion of the spindle 204, there is removably attached a rough grindstone T in the above described manner. In this state, by rotating the spindle 204, the finishing grindstone 205 and rough grindstone T can be rotated together in an integrated body.

Also, in case where the rough grindstone T is mounted in the tool mounting portion 206, the rough grindstone T is positioned nearer to a work W (which is a member to be worked) shown by a virtual line in FIG. 26 than the finishing grindstone 205. And, when the column 202 is moved in the direction of the work W, the tool (that is, the rough grindstone) T is allowed to execute a given rough grinding operation on the work W. At the then time, in case where the rough grindstone T is mounted in the tool mounting portion 206, the rough grindstone T is rotated by the spindle 204 to thereby grind the work W roughly. On the other hand, in case where the rough grindstone T is not mounted in the tool mounting portion 206, the finishing grindstone T is rotated by the spindle 204 to thereby finish grind the work W.

Also, on the base 201, there is disposed a frame 207 including a horizontal portion, while the end portion of the horizontal portion of the frame 207 extends up to a position above the spindle head 203. At a position, which is present in the end portion of the horizontal portion of the frame 207 and also which is present above the spindle head 203, there is supported a tool replacement device 208 in such a manner that it can be rotated around an axis which passes through the longitudinal direction of the device 208 and also which extends in parallel to the axis of the spindle 204. Further, in the two end portions of the tool replacement device 208, there are formed tool hold portions 208A, 208B respectively. And, in a state where the spindle 204 is held at its upper position, in case where the tool replacement device 208 is rotated, a rough grindstone T1 existing at a tool replacement position P1 and a rough grindstone T2 existing at a tool replacement position P2, more specifically, the grip portions of the two rough grindstones T1 and T2 are respectively held at the same time by the tool hold portions 208A, 208B of the tool replacement device 208, so that the two rough grindstones T1 and T2 can be removed and replaced.

On the horizontal portion of the frame 207, there is disposed a tool loader 209. This tool loader 209 is used to deliver rough grindstones T, T, - - - stored in a tool magazine 210 of a so called linear magazine type, which is formed as an oblong flat plate and extends in the axial direction of the spindle 204, up to the tool replacement position P1. In the upper edge portion of the tool magazine 210, there are formed a plurality of hold grooves 210*a*, 210*a*, - - - with a given pitch between them; and, these hold grooves 210*a*, 210*a*, - - - are respectively opened in the same direction, that is, in the upward direction. The rough grindstones T, T, - - - differing in roughness from one another are held by and stored in the hold grooves 210*a*, 210*a*, - - - , respectively.

Next, description will be given below of a procedure for grinding the work using a machining center M according to the invention.

That is, a given grindstone T for executing a first rough grinding operation is delivered from the tool magazine 210 up to the tool replacement position P1 by the tool loader 209. In this case, the rough grindstone is decided properly according to the work W and the degree of grinding; and, generally, there is used a rough grindstone T which has relatively large roughness. At the tool replacement position P1, the rough grindstone T delivered here by the tool loader 209 is held by the tool hold portion 208A of the tool replacement device 208. At the then time, no rough grindstone is mounted in the tool mounting portion 206 of the spindle 204 and, therefore, to mount the rough grindstone T into the tool mounting portion 206, the spindle 204 is moved to the tool replacement position P2.

Next, in a state where the rough grindstone T is held by the tool hold portion 208A but no rough grindstone is held by the tool hold portion 208B, the tool replacement device 208 is rotated. And, the rough grindstone T preset at the tool replacement position P1 is moved to the tool replacement position P2 and is then mounted into the tool mounting portion 206 of the spindle 204. In a state where, at the tool replacement position P2, the rough grindstone T is mounted in the tool mounting portion 206 of the spindle 204 and is thereby clamped to the spindle 204, not only the spindle base 203 is moved downward but also the column 202 is moved forward, thereby grinding the work W. In this case, in a state where the rough grindstone T is mounted in the tool mounting portion 206, the rough grindstone T mounted in the tool mounting portion 206 is positioned nearer to the work W than the finishing grindstone 205. Therefore, by rotating the spindle 204, the work W can be worked roughly using the rough grindstone T. While a given grinding operation is being executed using the rough grindstone T, the tool loader 209 returns back to the position of the tool magazine 210 and delivers a rough grindstone T to be used next up to the tool replacement position P1.

In case where the grinding operation using the first rough grindstone T is completed in this manner, the spindle base 203 is moved and the rough grindstone mounted in the tool mounting portion 206 of the spindle 204 is thereby moved up to the tool replacement position P2. At the then time, to the tool replacement position P1, there has been delivered the rough grindstone T, which is to be used next, by the tool loader 209. As the rough grindstone T to be used next, there is used a rough grindstone having smaller roughness than the first rough grindstone. However, although the roughness of the second rough grindstone is smaller than that of the first rough grindstone, it is not so small as the roughness that can be provided in a finishing grindstone requiring high grinding precision.

Now, the tool replacement device 208 is rotated by 180° from a state shown in FIGS. 26 and 27, so that the tool hold portion 208B is situated at the tool replacement position P1, whereas the tool hold portion 208A of the device 208 is situated at the tool replacement position P2. Thus, the rough grindstone T, which has been delivered to the tool replacement position P1 by the tool loader 209 and has not been used yet, is held by the tool hold portion 208B and, at the same time, the rough grindstone T, which has been delivered to the tool replacement position P2 by the spindle base 203 and has been used, is held by the tool hold portion 208A.

After the rough grindstones T, T are respectively held in this manner, the tool replacement device 208 is rotated by 180°, so that the tool hold portion 208A is moved to the tool replacement position P1, whereas the tool hold portion 208B is moved to the tool replacement position P2. At the tool replacement position P1, the rough grindstone T after used is received by the tool loader 209 and is then delivered up to a given position in the tool magazine 210 and stored there. On the other hand, at the tool replacement position P2, the rough grindstone T before used is mounted into the tool mounting portion 206 of the spindle 204. And, the spindle base 203 is moved downward to thereby move the column 202 more forward, so that the grinding operation on the work W is resumed.

In case where a similar operation to the above is repeated several times, there comes soon the time to execute a finish grinding operation on the work W. When executing the finish grinding operation on the work W, the spindle base 203 is moved and the rough grindstone T, which was mounted into the tool mounting portion 206 of the spindle 204 and was used at a previous stage, is delivered up to the tool replacement position P2. In this case, a new rough grindstone T is not delivered up to the tool replacement position P1 by the tool loader 209. Next, after the rough grindstone T is delivered to the tool hold portion 208A (or 208B) of the tool replacement device 208 at the tool replacement position P2, the spindle base 203 is moved downward and the column 202 is moved forward to thereby move the spindle 204 up to the position of the work W.

At the then time, since the finishing grindstone 205 is mounted on the spindle 204, in case the spindle 204 is rotated to thereby rotate the finishing grindstone 205, the finish working operation on the work W can be performed.

Description has been given heretofore of the preferred embodiments of a working apparatus according to the invention. However, the invention is not limited to the above-mentioned embodiments. For example, the rough grindstone holder can be replaced not only once or twice but also two or more times. Also, after completion of the finish grinding operation, a polishing tool such as a polishing cloth or a polishing pad, which does not require high mounting accuracy, can be mounted onto the tool mounting portion and a polishing operation can be executed using such polishing tool. Further, in the illustrated embodiments, as the automatic tool replacement device, there is used a tool replacing arm, and the rough grindstone holder is taken out from the grindstone stocker using such arm. However, this is not limitative but it is also possible to use an arm-less magazine which is used in an ordinary machining center.

Also, according to the invention, it is also possible to employ another structure; for example, a plurality of grindstones having the same mesh size may be previously stored in the grindstone stocker, and a similar grinding operation to the illustrated one may be executed by using these grindstones having the same mesh size sequentially. Further, a plurality of grindstones having the same mesh size may be prepared and, after one of the grindstones is used and worn out, a new grindstone having the same mesh size can be used.

On the other hand, in the above-mentioned embodiments, as the working apparatus, there is used a grinding apparatus and, as the finish working tool and rough working tool, there are used a finishing grindstone and a rough grindstone respectively. However, this is not limitative but, for example, as the working apparatus, there can be used a machining center. In case where the machining center is used, as the finish working tool, not only the finishing grindstone but also a milling cutter requiring high precision can be fixed to a main shaft serving as a spindle. Also, as the rough working tool, not only a rough grindstone but also a tool not requiring high accuracy can be mounted into the tool mounting portion.

As has been described heretofore, according to a first aspect of the invention, there is provided a one surface grinding apparatus for rotating a grinding tool mounted in a spindle to thereby grind one surface of a work, characterized by a tool mounting portion formed in the spindle; and, an automatic tool replacement device capable of not only mounting the grinding tool removably into the tool mounting portion but also replacing the grinding tool mounted in the tool mounting portion with a second grinding tool.

In the first aspect of the invention, in a spindle onto which a grinding tool can be mounted, there is formed a tool mounting portion such as a grindstone mounting portion; and, a grinding tool such as a grindstone to be mounted into the tool mounting portion can be replaced using an automatic tool replacement device. Thanks to this, a single spindle can be used and, when compared with a structure using two spindles, the whole one surface grinding apparatus can be reduced in size.

Also, an operation to replace a worn grinding tool can be facilitated, an operator can be set free from enormous time and labor necessary for the grinding tool replacing operation, and the grinding operation can be executed in a short time. Further, since the grinding operation can be carried out while replacing a grindstone with a second grindstone having different roughness, the grinding operation can be carried out with high efficiency as a whole.

According to a second aspect of the invention, in a one surface grinding apparatus as set forth in the first aspect of the invention, a specific grinding tool is fixedly disposed in the spindle; when a grinding tool is mounted in the tool mounting portion, the work is ground using the grinding tool mounted in the tool mounting portion; and, when no grinding tool is mounted in the tool mounting portion, the work is ground using the specific grinding tool fixedly disposed in the tool mounting portion.

In the second aspect of the invention, a specific grinding tool is fixedly disposed in the spindle and, therefore, in case where, as the specific grinding tool, there is fixedly mounted a grindstone such as a finishing grindstone which requires high grinding precision, the precision of the grinding operation can be enhanced. Also, in case where, as the specific grinding tool, there is fixedly mounted a grinding tool which is hardly replaced or a grinding tool which is frequently used, the replacing operation of the grinding tools can be reduced.

According to the third aspect of the invention, in a one surface grinding apparatus as set forth in the second aspect of the invention, the grinding tool fixedly disposed in the spindle is a finishing grindstone.

In case where a finish grinding operation is executed using a finishing grindstone, high grinding precision is required. In view of this, in the surface grinding apparatus as set forth in the third aspect of the invention, the finishing grindstone is fixedly disposed in the spindle. Due to this, there is reduced a possibility that the precision of the grinding operation can be lowered due to vibrations or mounting errors that could possibly occur in a case where the finishing grindstone is mounted into the tool mounting portion. Therefore, the finish grinding operation can be carried out with high precision.

According to the fourth aspect of the invention, in a one surface grinding apparatus as set forth in the third aspect of the invention, the grinding tool to be mounted into the tool mounting portion is a rough grindstone.

In the fourth aspect of the invention, the finishing grindstone is fixed to the spindle, the rough grindstone can be mounted into the tool mounting portion, and the rough grindstone can be replaced. Thanks to this, at a stage of execution of a first rough grinding operation, the rough grindstone is mounted into the tool mounting portion and a rough grinding operation is executed using the thus mounted rough grindstone. At a stage of execution of a finish grinding operation after completion of the rough grinding operation, the finish grinding operation can be executed using the finishing grindstone. In this manner, the grinding operations ranging from the rough grinding operation to the finish grinding operation can be carried out successively with no use of manual operations, which can contribute toward enhancing the efficiency of the grinding operation.

According to the fifth aspect of the invention, in a one surface grinding apparatus as set forth in any one of the first to fourth aspects of the invention, a grinding tool to be mounted into the tool mounting portion is a grain-containing brush.

In case where, after completion of the finish grinding operation using the finishing grindstone, the thus finish ground surface is brushed using the grain-containing brush to thereby be able to remove the surface damage of the ground surface, the breaking strength of the work (that is, the strength of the work when the work is broken) can be enhanced. Also, not only there can be omitted a post-processing such as an etching operation or a polishing operation as well as chemicals necessary in such post-processing, but also the cleaning of the surface of the work can be facilitated. In the fifth aspect of the invention, since a grain-containing brush capable of providing the above effects can be mounted into the tool mounting portion, after execution of the finish grinding operation, a brushing operation can be carried out continuously on the spot using the grain-containing brush. Therefore, when compared with a case in which a grain-containing brush is disposed in other brushing portion than the tool mounting portion, there can be omitted the need to move the work to such other brushing portion for the purpose of brushing the same. Also, the spindle used to rotate the finishing grindstone can also be used to carry out the brushing operation.

According to the sixth aspect of the invention, in a one surface grinding apparatus as set forth in the fifth aspect of the invention, the grain-containing brush is composed of a large number of nylon threads each of which is studded with diamond grains or $SiO_2$ grains fixed thereto.

As the grain-containing brush used in the invention, preferably, there may be used a brush which is composed of a large number of nylon threads each studded with diamond grains or $SiO_2$ grains fixed thereto. Here, the term "nylon", as known well, means fiber-state polyamide; by the way, polyamide is a generic name of polymers having —NH—CO— bonding in their principal chains.

According to the seventh aspect of the invention, in a one surface grinding apparatus as set forth in any one of the first to sixth aspects of the invention, a cover member for covering the tool mounting portion can be mounted onto and removed from the tool mounting portion.

During execution of the finish grinding operation using the finishing grindstone, in case where the tool mounting portion is opened or exposed, there is a fear that the tool mounting portion can be soiled with cut powder caused in the finish grinding operation. In this respect, in the seventh aspect of the invention, a cover member for covering the tool mounting portion can be mounted onto and removed from the tool mounting portion. Therefore, in execution of the finish grinding operation using the finishing grindstone, in case where the cover member is mounted onto the tool mounting portion, the tool mounting portion can be prevented from being soiled with the cut powder.

According to an eighth aspect of the invention, there is provided a one surface grinding method, comprising the steps of: mounting a grinding tool into a tool mounting portion formed in a spindle and grinding one surface of a work using the grinding tool; replacing the grinding tool mounted in the tool mounting portion with a second grinding tool and mounting the second grinding tool into the tool mounting portion using an automatic tool replacement device; and, after then, grinding the once-ground one surface of the work using the second grinding tool mounted in the tool mounting portion.

In the eighth aspect of the invention, since the grinding tool can be automatically replaced using an automatic tool replacing device, an operator need not replace the grinding tool by hand. Therefore, when carrying out work grinding operations ranging from a work rough grinding operation to a work finish grinding operation, the grinding tool can be replaced smoothly. Also, even in case where the grinding tool is worn and degraded, the degraded grinding tool can be smoothly replaced with a new grinding tool.

According to a ninth aspect of the invention, there is provided a one surface grinding method, comprising the steps of: mounting a rough grindstone into a tool mounting portion formed in a spindle and grinding one surface of a work using the rough grindstone; removing the rough grindstone mounted in the tool mounting portion with a second grinding tool using an automatic tool replacement device; and, after then, finish grinding the roughly ground surface of the work using a finishing grindstone fixedly disposed in the spindle.

In the ninth aspect of the invention, not only the grinding operations ranging from the rough grinding operation to the finish grinding operation can be carried out successively in a series of operations but also, since the finishing grindstone is fixed to the spindle, the finish grinding operation can be executed with high precision.

According to a tenth aspect of the invention, there is provided a one surface grinding method, comprising the steps of: mounting a rough grindstone into a tool mounting portion formed in a spindle and grinding one surface of a work using the rough grindstone; removing the rough grindstone mounted in the tool mounting portion with a second grinding tool using an automatic tool replacement device; finish grinding the roughly ground surface of the work using a finishing grindstone fixedly disposed in the spindle; mounting a grain-containing brush into the tool mounting portion formed in the spindle; and, after then, brushing the finish ground surface of the work using the grain-containing brush.

In the tenth aspect of the invention, after completion of the finish grinding operation using the finishing grindstone, by brushing the finish ground surface of the work using the grain-containing brush, the surface damage of the work can be removed so that the breaking strength of the work can be enhanced. Also, not only there can be omitted a post-processing such as an etching operation or a polishing operation as well as chemicals necessary in such post-processing, but also the cleaning of the ground surface of the work can be facilitated. Further, after the finish grinding operation is ended, the grain-containing brush is mounted into the tool mounting portion and the ground surface of the work is brushed using the grain-containing brush on the spot. Therefore, it is not necessary to move the work to other brushing position than the tool mounting portion for the purpose of brushing the same, but the finish ground work can be brushed using the grain-containing brush on the spot. Also, since the spindle used to rotate the finishing grindstone can also be used in the brushing operation, the one surface grinding apparatus can be prevented from being large in size as a whole.

According to an eleventh aspect of the invention, in a one surface grinding method as set forth in the ninth or tenth aspect of the invention, when finish grinding the roughly ground surface of the work using the finishing grindstone, a cover member for covering the tool mounting portion is mounted onto the tool mounting portion.

In the eleventh aspect of the invention, when executing the finish grinding operation using the finishing grindstone, the cover member is mounted onto the tool mounting portion. Thanks to this, the tool mounting portion can be prevented from being exposed during execution of the finish grinding operation, thereby being able to prevent the tool mounting portion from being soiled with cut powder that is produced through the finish grinding operation.

According to a twelfth aspect of the invention, there is provided a working apparatus for rotating a tool mounted into a spindle to thereby work a work, wherein, in the spindle, there is fixedly mounted a finish working tool and there is formed a tool mounting portion capable of mounting a rough working tool therein removably, and also wherein a cover member for covering the tool mounting portion can be mounted onto and removed from the tool mounting portion.

According to the twelfth aspect of the invention, the cover member for covering the tool mounting portion during execution of a finish working operation can be mounted onto and removed from the tool mounting portion. Due to this, when executing a finish grinding operation using a finishing grindstone fixed to the spindle, by mounting the cover member onto the tool mounting portion, the tool mounting portion is covered with the cover member. This makes it possible to prevent the tool mounting portion from being soiled.

According to a thirteenth aspect of the invention, in a working apparatus as set forth in the twelfth aspect of the invention, the finish working tool fixedly mounted into the spindle includes a finishing grindstone.

In the thirteenth aspect of the invention, the finish working tool fixedly mounted into the spindle includes a finishing grindstone. The finishing grindstone, because of its nature, requires high finishing precision and, therefore, it is preferred that the finishing grindstone is fixed to the spindle.

According to a fourteenth aspect of the invention, in a working apparatus as set forth in the twelfth or thirteenth aspect of the invention, the rough working tool includes a rough grindstone.

In the fourteenth aspect of the invention, as the rough working tool, there is used a rough grindstone. The rough grindstone does not require so high working accuracy as the finishing grindstone and, therefore, there arises no big problem in case where it is mounted into the tool mounting portion whenever it is used. Thus, as the rough grindstone, there can be conveniently used a grindstone which is to be mounted into the tool mounting portion in such a manner that it can be replaced with another one easily.

According to a fifteenth aspect of the invention, in a working apparatus as set forth in the twelfth aspect of the invention, the finish working tool includes a cup-type finishing grindstone and the rough working tool includes a cup-type rough grindstone, and also wherein, after one surface of the work is roughly ground using the cup-type rough grindstone, the roughly ground surface of the work is finish ground using the cup-type finishing grindstone.

In the fifteenth aspect of the invention, the finish working tool includes a cup-type finishing grindstone and the rough working tool includes a cup-type rough grindstone. This embodiment is suitable for use in a one surface grinding operation in which one surface of a work such as a wafer is ground.

According to a sixteenth aspect of the invention, in a working apparatus as set forth in the twelfth aspect of the invention, the finish working tool includes a disk-shaped finishing grindstone, the rough working tool includes a disk-shaped rough grindstone, and the work is a circular-shaped thin plate, and also wherein, after the edge of the circular-shaped thin plate is roughly ground using the disk-shaped rough grindstone, the roughly ground edge of the circular-shaped thin plate is finish ground using the disk-shaped finishing grindstone.

In the sixteenth aspect of the invention, the finish working tool is a disk-shaped finishing grindstone and the rough working tool is a disk-shaped rough grindstone. This embodiment is suitable for use as an edge grinding apparatus which is used to grind the edge portion of a work consisting of a circular-shaped thin plate.

According to a seventeenth aspect of the invention, in a working apparatus as set forth in any one of the twelfth to sixteenth aspects of the invention, two or more kinds of working tools including the rough working tool can be removably mounted into the tool mounting portion.

In the seventeenth aspect of the invention, two or more kinds of working tools including the rough working tool can be removably mounted into the tool mounting portion. Thanks to this, for example, after a rough grinding operation is executed using a rough working tool including a rough grindstone, a brushing member can be mounted into the tool mounting portion to thereby carry out a brushing operation. Also, a rough grinding operation can be executed smoothly step by step using a plurality of rough grindstones having different roughnesses. Further, a polishing tool including a polishing cloth or a polishing pad can be mounted into the tool mounting portion after completion of a finish grinding operation, so that a polishing operation can be carried out successively.

According to an eighteenth aspect of the invention, in a working apparatus as set forth in any one of the twelfth to fifteenth aspects of the invention, two or more kinds of working tools including the rough working tool can be removably mounted into the tool mounting portion and, as one of such two or more kinds of working tools, there is included a brushing tool with a grain-containing brush.

In the eighteenth aspect of the invention, in order to remove a working strain produced in the grinding surface of a work by a finish grinding operation, after completion of the finish grinding operation, a brushing member can be mounted into the tool mounting portion of the spindle to thereby carry out a brushing operation. In this case, since the brushing operation does not require such high precision as the finish grinding operation, from the viewpoint of working precision, it does not matter that the brushing member is mounted into the tool mounting portion and the brushing operation is executed by the brushing member.

According to a nineteenth aspect of the invention, in a working apparatus as set forth in the fifteen aspect of the invention, two or more kinds of working tools including the rough working tool can be removably mounted into the tool mounting portion, and one of the two or more kinds of working tools is a brushing tool with a grain-containing brush, and also wherein, after one surface of the work is finish ground using the cup-type finishing grindstone, the finish ground surface of the work is brushed using the brushing tool.

In the nineteenth aspect of the invention, after one surface of a work is finish ground using a cup-type finishing grindstone, the finish ground surface is brushed using a brushing tool. This can remove the working strain of the finish ground surface of the work, so that the deflective strength of the work (the strength where the work is broken) can be enhanced. Also, there are eliminated post-processing steps such as an etching step or a polishing step as well as chemicals and, in addition, an operation to clean the surface of the work can be facilitated.

According to a twentieth aspect of the invention, in a working apparatus as set forth in the nineteenth aspect of the invention, the grain-containing brush is composed of a large number of nylon threads with diamond grains or $SiO_2$ grains fixed thereto.

As a grain-containing brush used in the invention, as in the ninth aspect of the invention, there can be suitably used a brush which is composed of a large number of nylon threads with diamond grains or $SiO_2$ grains fixed thereto.

According to a twenty-first aspect of the invention, in a working apparatus as set forth in any one of the twelfth to twentieth aspect of the invention, there is further included an automatic tool replacement device capable of removing the working tool or the cover member mounted to the tool mounting portion, replacing the same with the cover member or a new working tool, and mounting the cover member or new working tool to the tool mounting portion.

In the twenty-first aspect of the invention, there is disposed an automatic tool replacement device (ATC) which is used to replace automatically a working tool or a cover member to be mounted to the tool mounting portion. Due to provision of the automatic tool replacement device, steps covering the rough working operation up to the finish working operation can be carried out successively and automatically.

According to an twenty-second aspect of the invention, in a working apparatus as set forth in the twenty-first aspect of the invention, the automatic tool replacement device comprises a turnable hold arm including a hold member capable of holding the working tool and cover member and, in each of the two outer end portions of the hold arm, there is disposed the hold member.

In the twenty-second aspect of the invention, the automatic tool replacement device comprises a turnable hold arm including a hold member capable of holding the working tool and cover member and, in each of the two outer end portions of the hold arm, there is disposed the hold member. Thanks to this, for example, while a tool mounted into the tool mounting portion is being held by one hold member, a new tool to be mounted into the tool mounting portion can be held by the other hold member. This makes it possible to carry out the automatic tool replacement in a short time.

According to a twenty-third aspect of the invention, in a working apparatus as set forth in the twenty-second aspect of the invention, the hold member can be opened and closed symmetrically with respect to an axis extending along the longitudinal direction of the hold arm, and, when the leading end portion of the hold member is closed, the working tool or cover member is held by the hold member.

In the twenty-third aspect of the invention, the hold member can be opened and closed symmetrically with respect to an axis extending along the longitudinal direction of the hold arm, and, when the hold member is closed, the rough working tool is held by the hold member. Therefore, in case where the hold member not holding the working tool remains opened, when turning the hold arm, the turn radius of the leading end portion of the hold member can be reduced. This can contribute toward reducing the size of the working apparatus as a whole.

According to a twenty-fourth aspect of the invention, in a working apparatus as set forth in the twenty-second or twenty-third aspect of the invention, there is further included a slider mechanism which is used to move the hold member along the longitudinal direction of the hold arm.

In the twenty-fourth aspect of the invention, there is disposed a slider mechanism which is used to move the hold member along the longitudinal direction of the hold arm. Due to provision of the slider mechanism, in case where the hold member holding the working tool is moved so as to approach the center of turn of the hold arm, the turn radius of the hold member holding the working tool can be reduced. This can further contribute to reduction in the size of the working apparatus as a whole.

According to a twenty-fifth aspect of the invention, in a working apparatus as set forth in any one of the twelfth to twenty-fourth aspect of the invention, there is further included a stocker including storage portions into which the working tool and cover member can be stored respectively.

In the twenty-fifth aspect of the invention, there is disposed a stocker into which two or more kinds of working tools including the rough working tool can be stored. In case where the automatic tool replacement device is set so as to be able to take out the rough working tool from the stocker, replacement of the rough working tool with other rough working tool can be carried out easily and smoothly.

According to a twenty-sixth aspect of the invention, in a working apparatus as set forth in the twenty-fifth aspect of the invention, the storage portions of the stocker are arranged along a locus to be drawn by the hold member when the hold arm is turned.

In the twenty-sixth aspect of the invention, the storage portions of the stocker are arranged along a locus to be drawn by the hold member when the hold arm is turned. This can prevent the moving distance of the turn arm from being long, thereby being able to further reduce the size of the working apparatus as a whole.

According to a twenty-seventh aspect of the invention, in a working apparatus as set forth in the twenty-fifth or twenty-sixth aspect of the invention, the cover member includes a main body portion to be mounted into the tool mounting portion and a cover holder portion to be held by the automatic tool replacement device, and the cover holder portion is mounted in such a manner that it can be separated from the main body portion, and also wherein, in the stocker, there is formed a cover holder storage portion into which, when the main body portion of the cover member is mounted into the tool mounting portion, the cover holder portion separated from the main body portion can be stored.

In the twenty-seventh aspect of the invention, the cover member includes a main body portion to be mounted into the tool mounting portion and a cover holder portion to be held by the automatic tool replacement device. And, when the main body portion is mounted into the tool mounting portion, the cover holder portion is removed from the main body portion. In this case, the cover holder portion is not necessary during execution of a working operation but, in the stocker, there is formed a cover holder storage portion into which the cover holder portion not necessary can be stored. When the cover holder is not necessary during execution of a finish working operation, the cover holder portion can be stored in the cover holder storage portion.

According to a twenty-eighth aspect of the invention, in a cover member for use in a working apparatus as set forth in any one of the twelfth to twenty-seventh aspect of the invention, there are included a main body portion to be mounted into the tool mounting portion and a cover holder portion to be held by the automatic tool replacement device.

In the twenty-eighth aspect of the invention, the cover member includes a main body portion to be mounted into the tool mounting portion and a cover holder portion to be held by the automatic tool replacement device. Thanks to this, when the cover member is mounted into the tool mounting portion formed in the spindle, while the cover holder portion is being held by the automatic tool replacement device, the main body portion can be mounted into the tool mounting portion.

According to a twenty-ninth aspect of the invention, in a cover member for use in a working apparatus as set forth in the twenty-eighth aspect of the invention, the cover holder portion is mounted in such a manner that it can be separated from the main body portion.

In the twenty-ninth aspect of the invention, the cover holder portion is mounted in such a manner that it can be separated from the main body portion. Due to this, when the main body portion is mounted in the tool mounting portion of the spindle during execution of a finish working operation, the cover holder portion to be held by the automatic tool replacement device is not necessary. Therefore, in case where the main body portion is mounted in the tool mounting portion during execution of a finish working operation, the cover holder portion can be separated and removed from the main body portion.

What is claimed is:

1. A working apparatus for working a work, comprising:

a spindle fixedly mounted with a first working tool for working the work in a specific manner, wherein said spindle is formed with a tool mounting portion onto which a second working tool is mountable, simultaneously.

2. The working apparatus according to claim 1, wherein said first working tool and said tool mounting portion are disposed concentrically with each other, and said second working tool mounted onto said tool mounting portion is disposed on a work side with respect to said first working tool.

3. The working apparatus according to claim 1, wherein said second working tool is a rough working tool having a rough grindstone.

4. The working apparatus according to claim 1, wherein said first working tool is a cup-shaped finishing grindstone, said second working tool is a cup-shaped rough grindstone, and said working apparatus is a one-surface grinding apparatus working only one surface of the work.

5. A working apparatus for working a work, comprising:

a spindle fixedly mounted with a first working tool for working the work in a specific manner, wherein said spindle is formed with a tool mounting portion onto which a second working tool is mountable; and a cover member mountable onto said tool mounting portion for covering said tool mounting portion.

6. A working apparatus for working a work, comprising:

a spindle fixedly mounted with a first working tool for working the work in a specific manner, wherein said spindle is formed with a tool mounting portion onto which a second working tool is mountable, and wherein said second working tool is a brushing tool having a brush with grains.

7. The working apparatus according to claim 6, wherein said brush is structured by a plurality of nylon threads fixed with at least one of diamond grains and $SiO_2$ grains.

8. A working apparatus for working a work, comprising:

a spindle fixedly mounted with a first working tool for working the work in a specific manner, wherein said spindle is formed with a tool mounting portion onto which a second working tool is mountable, and wherein the work is a circular thin plate, said first working tool is a disk-shaped finishing grindstone, said second working tool is a disk-shaped rough grindstone, and said working apparatus is an edge grinding apparatus grinding an edge of the circular thin plate.

9. A working apparatus for working a work, comprising:

a spindle fixedly mounted with a first working tool for working the work in a specific manner, wherein said spindle is formed with a tool mounting portion onto which a second working tool is mountable;

a third working tool mountable onto said tool mounting portion; and an automatic tool replacement device for removing said second working tool mounted onto said tool mounting portion and mounting said third working tool onto said tool mounting portion.

10. The working apparatus according to claim 9, further comprising:

a cover member mountable onto said tool mounting portion, wherein said automatic tool replacement device removes one of said second working tool and said cover member mounted onto said tool mounting portion, and mounts one of said cover member and said third working tool onto said tool mounting portion.

11. The working apparatus according to claim 10, wherein said automatic tool replacement device comprises a turnable hold arm with a hold member holding said working tools and said cover member, and said hold member is disposed on an outer end portion of said hold arm.

12. The working apparatus according to claim 11, wherein said hold member are opened and closed symmetrically with respect to an axis extending along the longitudinal direction of said hold arm, and said hold member holds one of said working tool and said cover member by closing a leading end portion of said hold member.

13. The working apparatus according to claim 9, further comprising:

a stocker including storage portions storing said at least one of working tool and said cover member therein.

14. The working apparatus according to claim 13, wherein said cover member includes a main body portion to be mounted onto said tool mounting portion and a cover holder portion to be held by said automatic tool replacement device, said cover holder portion is attached to said main body portion such as to be separated from said main body portion, and said stocker includes a cover holder storage portion storing said cover holder portion separated from said main body portion, when said main body portion of said cover member is mounted onto said tool mounting portion.

15. A working apparatus for working a work, comprising:

a spindle fixedly mounted with a first working tool for working the work in a specific manner, wherein said spindle is formed with a tool mounting portion onto which a second working tool is mountable, and wherein said working apparatus is a machining center.

16. A working method for working a work by using a working apparatus that includes a spindle fixedly mounted with a first working tool for working the work in a specific manner, wherein said spindle is formed with a tool mounting portion onto which a second working tool is mountable simultaneously with said first working tool, comprising the steps of:

a first step working the work by said second working tool mounted onto said tool mounting portion of said spindle; and a second step working the work by said first working tool mounted to said spindle.

17. The working method according to claim 16, wherein said first step performs a rough grinding of one surface of the work by a rough working tool having a rough grindstone being said second working tool, and said second step performs a finish grinding of the one surface of the work by a finish working tool having a finishing grindstone being said first working tool, thereby performing the one-surface grinding of the work.

18. The working method according to claim 17, further comprising the steps of:

removing said rough grindstone mounted onto said tool mounting portion after said first step;

mounting a brushing tool having a brush with grains onto said tool mounting portion after said second step; and brushing the one surface of the work by said brushing tool mounted onto said tool mounting portion.

19. The working method according to claim 16, wherein the work is a circular-shaped thin plate, said first step performs a rough grinding of an edge of the circular thin plate by a rough working tool having a rough grindstone being said second working tool, and said second step performs a finish grinding of the edge of the circular thin plate by a finish working tool having a fishing grindstone being said first working tool, thereby performing the edge grinding of the work.

20. The working method according to claim 16, wherein said first step performs a rough grinding of the work by a plurality of rough working tools respectively having rough grindstones which are different in roughness from each other being said second working tool, and said second step performs a finish grinding of the work by a finish working tool having a finishing grindstone being said first working tool.

21. The working method according to claim 16, wherein, in said second step, a cover member is mounted onto said tool mounting portion.

* * * * *